US008051763B2

(12) United States Patent
Kuwabara et al.

(10) Patent No.: US 8,051,763 B2
(45) Date of Patent: Nov. 8, 2011

(54) HYDRAULIC APPARATUS

(75) Inventors: Shinya Kuwabara, Susono (JP); Tadashi Fujiyoshi, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 22 days.

(21) Appl. No.: 12/669,126

(22) PCT Filed: Jul. 18, 2008

(86) PCT No.: PCT/JP2008/063054

§ 371 (c)(1),
(2), (4) Date: Jan. 14, 2010

(87) PCT Pub. No.: WO2009/011429

PCT Pub. Date: Jan. 22, 2009

(65) Prior Publication Data

US 2010/0202902 A1 Aug. 12, 2010

(30) Foreign Application Priority Data

Jul. 19, 2007 (JP) ..... 2007-188213

(51) Int. Cl.
*F01B 1/06* (2006.01)

(52) U.S. Cl. ..... 91/498; 417/270; 417/273

(58) Field of Classification Search ..... 417/270, 417/273, 219; 91/497, 482, 490, 498
See application file for complete search history.

(56) References Cited

U.S. PATENT DOCUMENTS

| | | | | |
|---|---|---|---|---|
| 3,785,250 | A * | 1/1974 | Steiger | 92/72 |
| 4,006,668 | A * | 2/1977 | Steiger | 91/497 |
| 4,889,096 | A * | 12/1989 | Brunel | 123/450 |
| 5,901,802 | A | 5/1999 | Sunohara et al. | |
| 7,048,516 | B2 * | 5/2006 | Maier et al. | 417/273 |
| 2009/0060765 | A1 * | 3/2009 | Kuwabara et al. | 417/462 |

FOREIGN PATENT DOCUMENTS

| | | |
|---|---|---|
| JP | 156527 | 5/1943 |
| JP | 51 143034 | 11/1976 |
| JP | 62 34183 | 2/1987 |
| JP | 2 108866 | 4/1990 |
| JP | 9 303256 | 11/1997 |
| JP | 2004 190522 | 7/2004 |
| JP | 2006 112460 | 4/2006 |
| JP | 2006 349114 | 12/2006 |

* cited by examiner

*Primary Examiner* — Charles Freay
*Assistant Examiner* — Todd D Jacobs
(74) *Attorney, Agent, or Firm* — Oblon, Spivak, McClelland, Maier & Neustadt, L.L.P.

(57) ABSTRACT

In a hydraulic apparatus, a first rotating member and a second rotating member are provided so as to be relatively rotatable with a same central axis, a cam is provided on the first rotating member, pistons are arranged on the second rotating member so as to be opposed to the cam, the pistons are pressed against the cam to contact by compression coil springs, oil chambers of which volumes are expanded and contracted according to movements of the pistons are provided on the second rotating member, first and second fluid paths through which oil flows into and out from the oil chambers are provided, and a path switching device for switching an inflow direction and an outflow direction of the oil in the first and second fluid paths according to difference in pressure between the first and second fluid paths is provided.

9 Claims, 9 Drawing Sheets

HYDRAULIC APPARATUS

TECHNICAL FIELD

The present invention especially relates to a hydraulic apparatus used in an automatic transmission of a vehicle.

BACKGROUND ART

As the hydraulic apparatus, there is a radial piston pump for sucking operation fluid and discharging the same to supply to a required portion, for example, and this is disclosed in a following patent document 1. In the radial piston pump disclosed in the patent document 1, a valve shaft having a suction port, a discharge port, a suction slot and a discharge slot is provided in a housing, a rotor is supported so as to be rotatable relative to the valve shaft, a cam ring is rotatably provided on an outer side of the rotor, a cylinder is radially provided on the rotor, and a piston is slidably mounted on the cylinder, thereby forming a pump chamber for selectively communicating with the suction slot and the discharge slot. Therefore, the operation fluid is sucked from the suction port through the suction slot into the pump chamber, and discharged through the discharge slot to the discharge port.

There is a case in which such radial piston pump is incorporated in the automatic transmission of the vehicle, the rotor of the radial piston pump is coupled to one of an input shaft and an output shaft, the cam ring of the radial piston pump is coupled to the other of the input shaft and the output shaft, to be used as an oil pump for discharging the oil according to difference in rotational speed between the input shaft and the output shaft, that is to say, a differential oil pump. In this case, at the time of positive driving such as when accelerating the vehicle, that is to say, when the rotational speed of the input shaft is higher than that of the output shaft and the input shaft relatively positively rotates, the radial piston pump can operate to discharge the operation fluid. However, at the time of being driven in which an engine brake acts on the vehicle, that is to say, when the rotational speed of the input shaft is lower than that of the output shaft and the input shaft relatively negatively rotates, a suction stroke and a discharge stroke of the operation fluid by the piston are inverted and the radial piston pump cannot discharge the operation fluid.

Therefore, in a following patent document 2, for example, a check valve is used to be able to appropriately discharge the operation oil at positive rotation and negative rotation of the input shaft. That is to say, in the oil pump of the patent document 2, a suction opening of the oil pump is connected to a liquid retaining unit through a first check valve and a discharge opening of the oil pump is connected to a discharge liquid requiring unit through a second check valve, and the discharge opening of the oil pump is connected to the liquid retaining unit through a third check valve and the suction opening of the oil pump is connected to the discharge liquid requiring unit through a fourth check valve, and it is arranged such that when the oil pump positively rotates, only the first and second check valves are opened, and when the oil pump negatively rotates, only the third and fourth check valves are opened. Therefore, the oil pump can discharge a predetermined flow amount regardless of a rotational direction of the motor.

In the conventional oil pump disclosed in the above-described patent document 2, a plurality of check valves are provided on the suction opening and the discharge opening of the oil pump, so that the oil can be discharged regardless of the rotational direction of the motor by opening the one group of check valves when the oil pump positively rotates and opening the other group of check valves when the oil pump negatively rotates. However, the check valve is for releasing a pressure of the oil when this is higher than a predetermined pressure, so that pressure loss of the oil is large and cavitation and operational inadequacy of the piston (cam nose jumping phenomenon) easily occur when sucking the oil, and further, there is a problem that mechanical efficiency deteriorates.

In addition, although the differential oil pump is for sucking to discharge the oil as the operation fluid according to the rotational speeds of two rotating bodies, it is desirable that this is used as the motor for obtaining power by rotating one rotating body by supplying the oil while restraining the other rotating body. However, in the above-described conventional oil pump, a plurality of check valves are provided on the suction opening and the discharge opening of the oil pump, so that it is difficult to allow the same to serve as the motor.

Patent Document 1: Japanese Patent Application Laid-open No. 02-108866

Patent Document 2: Japanese Patent Application Laid-open No. 09-303256

DISCLOSURE OF INVENTION

Problem to be Solved by the Invention

An object of the present invention is to provide the hydraulic apparatus, which improve the mechanical efficiency and versatility by efficiently supplying the fluid regardless of the rotational direction of the rotating member.

Means for Solving Problem

A hydraulic apparatus according to the present invention includes a first rotating member and a second rotating member provided so as to be relatively rotatable with a central axis; a cam provided on the first rotating member; a piston provided on the second rotating member so as to be opposed to the cam and movable along a radial direction; a pressing unit that presses the piston against the cam to contact; a fluid chamber provided on the second rotating member, the chamber having a volume expanded and contracted according to a movement of the piston; a first fluid path and a second fluid path through which fluid flows into or out from the fluid chamber; and a path switching device that switches an inflow direction and an outflow direction of the fluid in the first fluid path and the second fluid path according to difference in pressure between the first fluid path and the second fluid path.

According to one aspect of the embodiment, it is preferable that the path switching device has a moving body that switches the inflow direction and the outflow direction of the fluid in the first fluid path and the second fluid path by moving according to the difference in pressure between the first fluid path and the second fluid path.

According to one aspect of the embodiment, it is preferable that the moving body is movable to a first movement position for setting the first fluid path to the outflow direction of the fluid and switching the second fluid path to the inflow direction of the fluid, and to a second movement position for setting the first fluid path to the inflow direction of the fluid and switching the second fluid path to the outflow direction of the fluid, and the moving body is biasingly supported at the first movement position by a biasing unit.

According to one aspect of the embodiment, it is preferable that an input shaft is coupled to the first rotating member and the input shaft is coupled to the second rotating member, and the biasing unit biasingly supports the moving body such that a pressure in the first fluid path or the second fluid path communicating with a fluid supplying unit becomes higher when a rotational speed of the first rotating member is higher than the rotational speed of the second rotating member.

According to one aspect of the embodiment, it is preferable that the path switching device includes: a housing; a first port and a second port provided in the housing with which the first fluid path and the second fluid path communicate, respectively; a suction port and an exhaust port provided in the housing with which a fluid suction path and a fluid exhaust path communicate; a spool movably supported in the housing that switches a communication relationship between the first port and the second port and the suction port and the exhaust port; a first pressure port provided in the housing with which a pressure in the first fluid path acts on the spool; and a second pressure port provided in the housing with which the pressure in the second fluid path acts on the spool.

According to one aspect of the embodiment, it is preferable that the path switching device includes: a rotating body concentrically and rotatably supported inside the second rotating member; a suction chamber provided on the rotating body with which a fluid suction path communicates and the first fluid path or the second fluid path can communicate; an exhaust chamber provided on the rotating body with which a fluid exhaust path communicates and the first fluid path or the second fluid path can communicate; a first pressure chamber rotatable by the pressure in the first fluid path acting on the rotating body; and a second pressure chamber rotatable by the pressure in the second fluid path acting on the rotating body, and wherein the path switching device is capable of switching a communication relationship between the first fluid path and the second fluid path and the suction chamber and the exhaust chamber according to a rotational position of the rotating body.

According to one aspect of the embodiment, it is preferable that the path switching device is coupled to a fluid retaining unit through the fluid suction path and is coupled to the fluid supplying unit through the fluid exhaust path, and a control valve that controls a flow amount of the fluid is provided at least one of the fluid suction path and the fluid exhaust path.

According to one aspect of the embodiment, it is preferable that the input shaft is coupled to one of the first rotating member and the second rotating member and an output shaft is coupled to the other of the first rotating member and the second rotating member, the piston reciprocates according to difference in rotational speed between the first rotating member and the second rotating member, and the fluid is sucked and discharged through the first fluid path and the second fluid path by varying pressure in the fluid chamber.

According to one aspect of the embodiment, it is preferable that the hydraulic apparatus further includes a restraining unit capable of restraining the first rotating member or the second rotating member, and a fluid supplying unit capable of supplying the fluid in the first fluid path or the second fluid path.

Effect of the Invention

According to the hydraulic apparatus of the present invention, it is possible to efficiently supply the fluid regardless of the rotational direction of the rotating member to improve the mechanical efficiency and improve the versatility.

EXPLANATIONS OF LETTERS OR NUMERALS

Figure 1:
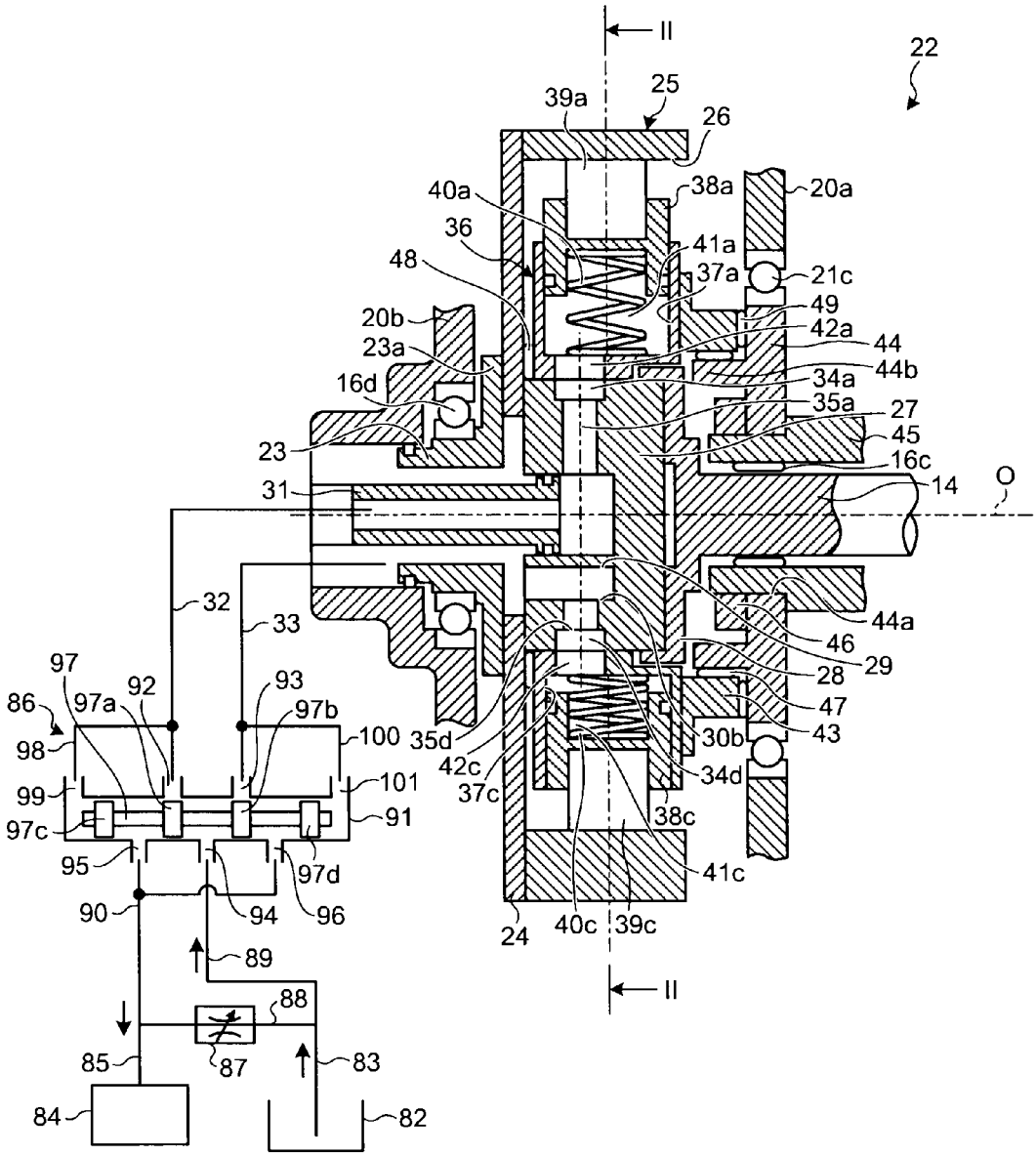
FIG. 1 is a schematic configuration diagram of an oil pump showing a hydraulic apparatus according to a first embodiment of the present invention.

11 engine
12 crankshaft
14 input shaft (input shaft)
15 primary shaft
17 casing
22, 111, 151 oil pump (hydraulic apparatus)
25 first rotating member
26 cam
27, 112 rotary valve
29 first communication hole
30*a*, 30*b* second communication hole
32 first oil passage
33 second oil passage
34*a* to 34*d*, 113*a* to 113*d* coupling groove
35*a* to 35*d*, 114*a* to 114*d* coupling hole
36 second rotating member
37*a* to 37*h* cylinder
38*a* to 38*h* piston
39*a* to 39*h* roller
40*a* to 40*h* compression coil spring (pressing unit)
41*a* to 41*h* oil chamber
42*a* to 42*h* coupling hole
45 output shaft (output shaft)
51 forward/reverse switching device
58 stepless transmission
71 electronic control device, ECU
81 hydraulic control device
82 oil retaining unit (fluid retaining unit)
83 first oil suction path (fluid suction path)
84 oil supplying unit (fluid supplying unit)
85 first oil exhaust path (fluid exhaust path)
86, 131, 141 path switching device
89 second oil suction path (fluid suction path)
90 second oil exhaust path (fluid exhaust path)
87 control valve
91 housing

97 spool (moving body)
115 rotating body (path switching device, moving body)
116 exhaust chamber
117*a*, 117*b* suction chamber
121*a* to 121*d*, 122*a*, 122*b* coupling hole
123*a*, 123*b* first pressure chamber
124*a*, 124*b* second pressure chamber
142 compression coil spring (biasing means)
152 brake (restraining means)
153 oil pressure source (fluid supplying means)

BEST MODE(S) FOR CARRYING OUT THE INVENTION

The present invention relates to a hydraulic apparatus used in an automatic transmission of a vehicle, and can be used as a pump, a power transmission device and a motor. The pump is capable of sucking fluid therein and discharging the same to outside by allowing a piston to reciprocate along a cam shape by relatively rotating first and second rotating members. The power transmission device transmits power to the first or second rotating member, and by relatively rotating the first and second rotating members, this allows the piston to reciprocate along the cam shape, and can transmit the power between the first and second rotating members by engaging force of the piston and the cam. The motor supplies the fluid therein and exhausts the same to outside to operate the piston, thereby relatively rotating the first and second rotating members by the engaging force of the piston and the cam to take out the power.

Preferably, relatively rotatable first and second rotating members are provided, the cam is provided on the first rotating member, the piston opposed to the cam and movable in a radial direction is provided on the second rotating member and the piston is pressed against the cam to contact by a pressing unit, a fluid chamber of which volume is expanded and contracted according to a movement of the piston is provided on the second rotating member, first and second fluid paths through which the fluid flows into or out from the fluid chamber are provided, and a path switching device for switching an inflow direction and an outflow direction of the fluid according to difference in pressure between the first and second fluid paths is provided. According to this, the path switching device switches the inflow direction and the outflow direction of the fluid according to the difference in pressure between the first and second fluid paths, so that the fluid can be supplied to a predetermined oil passage regardless of a rotational direction of the rotating member and moreover mechanical efficiency can be improved, and by allowing the same to serve as a device for taking out the power, versatility thereof can be improved.

Preferably, the path switching device has a moving body, which moves according to the difference in pressure between the first and second fluid paths, to switch the inflow direction and the outflow direction of the fluid in the first and second fluid paths. According to this, it is possible to switch the inflow direction and the outflow direction of the fluid in each fluid path by moving the moving body according to the difference in pressure between the first and second fluid paths, and the fluid can be appropriately sucked and discharged with a simple structure.

Preferably, the moving body is movable to a first movement position for setting the first fluid path to the outflow direction of the fluid and switching the second fluid path to the outflow direction of the fluid, and to a second movement position for setting the first fluid path to the inflow direction of the fluid and switching the second flow path to the outflow direction of the fluid, and is biasingly supported at the first movement position by biasing means. According to this, the inflow direction of the oil and the outflow direction of the oil can be switched by moving the moving body to the first and second movement positions according to the difference in pressure between the first and second fluid paths, and the oil can be sucked and discharged with the simple structure and by simple operation.

Preferably, an input shaft is coupled to the first rotating member and the input shaft is coupled to the second rotating member, and the biasing means biasingly supports the moving body such that pressure in the first fluid path or the second fluid path, which communicates with a fluid supplying unit, becomes high when the rotational speed of the first rotating member is higher than that of the second rotating member. According to this, the moving body is biasingly supported by the biasing means, so that a backflow of the fluid can be prevented at the time of start and the fluid can be discharged at an early stage, and also the simple structure can be obtained.

Preferably, the path switching device has a housing, a first port and a second port provided in the housing with which the first and second fluid paths communicate, respectively, suction and exhaust ports provided in the housing with which a fluid suction path and a fluid exhaust path communicate, respectively, a spool movably supported in the housing for switching a communication relationship between the first and second ports and the suction and exhaust ports, a first pressure port provided in the housing in which the pressure in the first fluid path acts on the spool, and a second pressure port provided in the housing with which the pressure in the second fluid path acts on the spool. According to this, by allowing oil pressures in the first and second fluid paths to act on the spool through each pressure port, the spool is moved to the first movement position or the second movement position according to the difference in pressure therebetween, and the communication relationship between the first and second ports and the suction and exhaust ports can be switched by the movement of the spool, so that the fluid can be appropriately sucked and discharged.

Preferably, the path switching device has a rotating body concentrically rotatably supported inside the second rotating member, a suction chamber provided on the rotating body with which the fluid suction path communicates and the first fluid path or the second fluid path can communicate, an exhaust chamber provided on the rotating body with which the exhaust path communicates and the first fluid path or the second fluid path can communicate, a first pressure chamber rotatable by the pressure in the first fluid path acting on the rotating body, and a second pressure chamber rotatable by the pressure in the second fluid path acting on the rotating body, and is capable of switching the communication relationship between the first and second fluid paths and the suction and exhaust chambers according to a rotational position of the rotating body. According to this, a smaller device can be obtained due to improved space efficiency, and a large opening area of the oil passage can be ensured, so that pressure loss can be further suppressed, and since the rotating body is rotatable relative to the second rotating member, operational inadequacy can be prevented.

Preferably, the path switching device is coupled to a fluid retaining unit through the fluid suction path and is coupled to the fluid supplying unit through the fluid exhaust path, and a control valve for controlling a flow amount of the fluid is provided at least one of the fluid suction path and the fluid exhaust path. According to this, by controlling the flow amount of the fluid to one of the fluid suction path and the fluid exhaust path by the control valve, a torque transmission amount between the first and second rotating members can be adjusted, so that the oil can be appropriately sucked and exhausted, and the torque can be appropriately transmitted between the first and second rotating members.

Preferably, the input shaft is coupled to one of the first and second rotating members and an output shaft is coupled to the other of them, the piston reciprocates by the difference in rotational speed between the first and second rotating members and the pressure in the fluid chamber changes, thereby, the fluid is sucked and discharged through the first and second fluid paths. According to this, an appropriate discharge amount of the oil can be ensured based on the difference in rotational speed between the first and second rotating members.

Preferably, restraining means capable of restraining the first or second rotating member and fluid supplying means capable of supplying the fluid to the first or second fluid path are provided. According to this, by supplying the fluid to the first or second fluid path by the fluid supplying means to rotate in a state in which the first or second rotating member is restrained by the restraining means, this can serve as the motor.

Hereinafter, embodiments of the hydraulic apparatus according to the present invention are described in detail with reference to drawings. Meanwhile, the present invention is not limited by the embodiments.

First Embodiment

Figure 2:
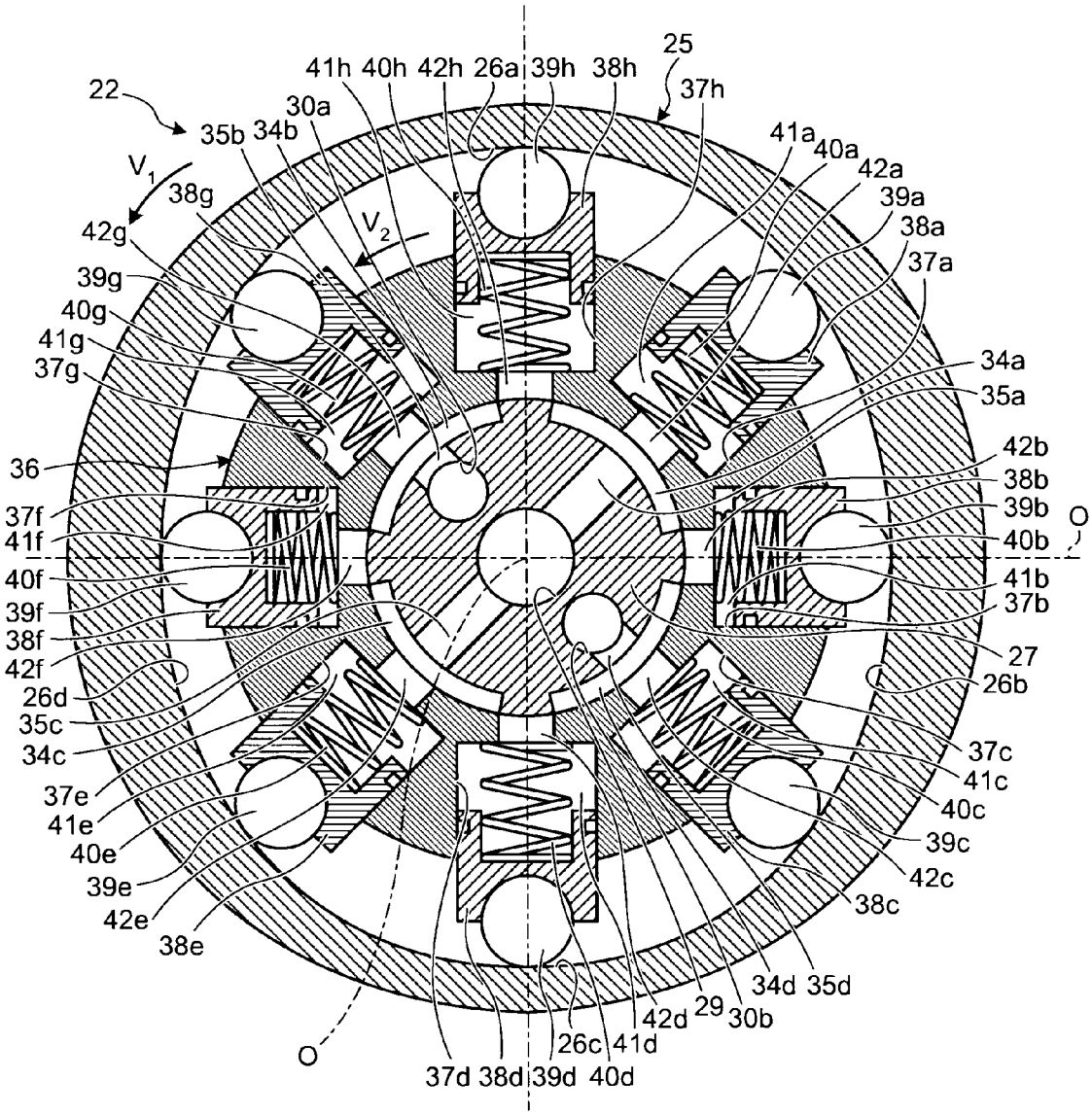
FIG. 2 is a cross-sectional view taken along line II-II of FIG. 1.
Figure 3:
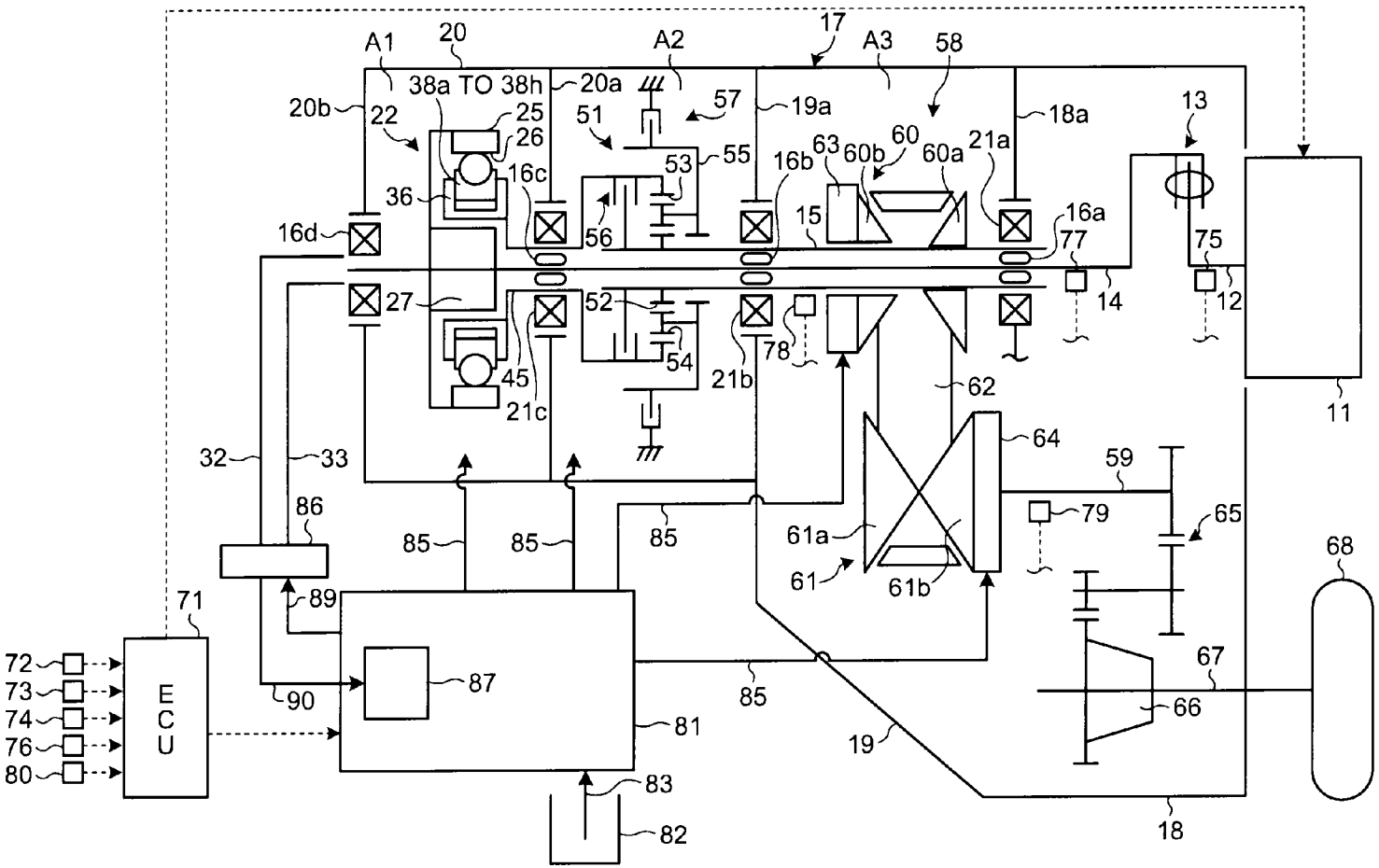
FIG. 3 is a schematic configuration diagram showing a drive transmission system of a vehicle to which the oil pump of the first embodiment is applied.

FIG. 1 is a schematic configuration diagram of an oil pump showing a hydraulic apparatus according to a first embodiment of the present invention, FIG. 2 is a cross-sectional view taken along line II-II of FIG. 1, and FIG. 3 is a schematic configuration diagram showing a drive transmission system of the vehicle to which the oil pump of the first embodiment is applied.

In the drive transmission system of the vehicle to which the hydraulic apparatus of the first embodiment is applied, as shown in FIG. 3, an engine 11 as a prime mover is provided and an input shaft 14 is coupled to a crankshaft 12 of the engine 11 through a dumper device 13, and it is configured such that engine torque is transmitted to the input shaft 14.

On the input shaft 14, a primary shaft 15 is supported on an outer peripheral side thereof so as to be relatively rotatable through a plurality of bearings 16*a*, 16*b*, 16*c* and 16*d*. The input shaft 14 and the primary shaft 15 are arranged in a casing 17. The casing 17 is composed of a front case 18, a center case 19 and a rear case 20 joined to be fixed by a coupling bolt not shown. Continuous partition walls 18*a*, 19*a*, 20*a* and 20*b* are provided on inner surfaces of the front case 18, the center case 19 and the rear case 20, and the primary shaft 15 is rotatably supported on the partition walls 18*a*, 19*a*, 20*a* and 20*b* through bearings 21*a*, 21*b* and 21*c*.

A first accommodating chamber A1 is formed inside the casing 17 in a space enclosed by the partition walls 20*a* and 20*b* of the rear case 20. An oil pump 22 as the hydraulic apparatus of this embodiment is provided in the first accommodating chamber A1. The oil pump 22 is a radial piston pump.

In the oil pump 22, as shown in FIGS. 1 and 2, a cylindrical sleeve 23 is rotatably supported on the partition wall 20*b* of the rear case 20 through a bearing 16*d*. In the sleeve 23, a circular rotating plate 24 is fixed to a flange portion 23*a*, and a cylindrical first rotating member 25 is fixed to the rotating plate 24. A cam 26 is provided on an inner peripheral surface of the first rotating member. The cam 26 is formed such that radially opposing first cam surfaces 26*a* and 26*c* and radially opposing second cam surfaces 26*b* and 26*d* are alternately arranged in a peripheral direction to be smoothly continuous. In this case, it is set that distances from a central axis O of the first rotating member 25 to the first cam surfaces 26*a* and 26*c* are longer than distances from the central axis O of the first rotating member 25 to the second cam surfaces 26*a* and 26*c*.

Also, a rotary valve 27 is joined to the rotating plate 24, and an end plate 28 integrally formed on an end portion of the input shaft 14 fits an outer peripheral surface of the rotary valve 27 to be integrally joined.

In the rotary valve 27, a first communication hole 29 is formed from one end face to a central portion thereof, and two second communication holes 30*a* and 30*b* are formed on an outer peripheral side of the first communication hole 29. A cylindrical holder 31 passes through the sleeve 23 and an end portion thereof fits the first communication hole 29 to be fixed, thereby forming a first oil passage 32 communicating from an inside the holder 31 to the first communication hole 29, and a second oil passage 33 communicating from a portion between the sleeve 23 and the holder 31 to the second communication holes 30*a* and 30*b*. Also, in the rotary valve 27, four coupling grooves 34*a*, 34*b*, 34*c* and 34*d* are formed on the outer peripheral surface thereof in a peripheral direction, and the first communication hole 29 communicates with the coupling grooves 34*a* and 34*c* by the coupling holes 35*a* and 35*c*, respectively, on the other hand, the second communication holes 30*a* and 30*b* communicate with the coupling grooves 34*b* and 34*d* by the coupling holes 35*a* and 35*b*, respectively.

In the rotary valve 27, a cylindrical second rotating member 36 rotatably fits the outer peripheral surface thereof. In the second rotating member 36, eight cylinders 37*a* to 37*h* are formed on an outer peripheral portion thereof at even intervals in the peripheral direction so as to open outward, and pistons 38*a* to 38*h* are movably supported on the cylinders 37*a* to 37*h*, respectively, in a radial direction of the rotary valve 27. Rollers 39*a* to 39*h* are mounted on tip ends of the pistons 38*a* to 38*h*, respectively, and the rollers 39*a* to 39*h* are rotatably supported around an axis parallel to an axial direction of the rotary valve 27. Also, compression coil springs 40*a* to 40*h* as pressing units are interposed in the cylinders 37*a* to 37*h*, respectively, and the compression coil springs 40*a* to 40*h* press the rollers 39*a* to 39*h* of the cylinders 37*a* to 37*h*, respectively, against the cam surface 26*a*, 26*b*, 26*c* and 26*d* of the cam 26 to contact, by biasing force thereof.

That is to say, each of the pistons 38*a* to 38*h* are arranged so as to be opposed to the cam 26 of the first rotating member 25 in the radial direction, and the rollers 39*a* to 39*h* contact the cam surfaces 26*a*, 26*b*, 26*c* and 26*d* of the cam 26 by the biasing force of the compression coil springs 40*a* to 40*h*. Sealed oil chambers 41*a* to 41*h* are formed between the pistons 38*a* to 38*h* and the cylinders 37*a* to 37*h*, respectively, and when the first and second rotating members 25 and 36 relatively rotate, each of the pistons 38*a* to 38*h* reciprocate by the cam surfaces 26*a*, 26*b*, 26*c* and 26*d* through the rollers 39*a* to 39*h*, so that the volumes of the oil chambers 41*a* to 41*h* are expanded or contracted. Also, the oil chambers 41*a* to 41*h* can communicate with the coupling grooves 34*a* to 34*d* through the coupling holes 42*a* to 42*h*.

In addition, a cylindrical coupling tube 43 is fixed to one plane surface portion of the second rotating member 36. On the other hand, a circular supporting plate 44 is rotatably supported on the partition wall 20*a* of the rear case 20 through the bearing 21*c*, and an end portion of a cylindrical output shaft 45 fits a through-hole 44*a* of the supporting plate 44 to be integrally joined by a joining member 46. An outer peripheral portion of a flange portion 44*b* integrally formed with the supporting plate 44 fits an inner peripheral portion of the coupling tube 43 by a spline 47, and the coupling tube 43 and the supporting plate 44, that is to say, the second rotating member 36 and the output shaft 45 are coupled so as to be integrally rotatable. Meanwhile, a bearing 48 is interposed between the other plane surface portion of the second rotating member 36 and the rotating plate 24, a bearing 49 is interposed between the coupling tube 43 and the supporting plate 44, and a bearing 16*c* is interposed between the input shaft 14 and the output shaft 45.

As shown in FIG. 3, a second accommodating chamber A2 is formed inside the casing 17 in a space enclosed by the partition wall 19*a* of the center case 19 and the partition wall 20*a* of the rear case 20. A forward/reverse switching device 51 is provided in the second accommodating chamber A2. The forward/reverse switching device 51 is for switching the rotational direction of the primary shaft 15 between positive rotation and negative rotation relative to the rotational direction of the output shaft 45, and is arranged between the engine 11 and the oil pump 2.

The forward/reverse switching device 51 has a planetary gear mechanism, specifically, a single pinion planetary gear mechanism. That is to say, the planetary gear mechanism is composed of a sun gear 52, a ring gear 53 arranged concentrically with the sun gear 52, a plurality of pinion gears 54 meshing with the sun gear 52 and the ring gear 53, and a carrier 55 for rotatably and revolvably supporting the pinion gears 54. The sun gear 52 is drive-coupled to the primary shaft 15, and the ring gear 53 is drive-coupled to the output shaft 45. Also, a forward clutch 56 for controlling coupling and release of rotational elements composing the forward/reverse switching device 51 is provided, and a reverse brake 57 for controlling rotation and stop of the rotational elements is provided. The forward clutch 56 can control coupling and release of the sun gear 52 and the ring gear 53, and the reverse brake 57 can control rotation and stop of the carrier 55.

Meanwhile, a friction clutch, an electromagnetic clutch, a mesh clutch or the like can be applied as the above-described forward clutch 56, and a friction brake, an electromagnetic brake, a mesh brake or the like can be applied as the reverse brake 57. A hydraulic control actuator is used when applying the friction clutch, the mesh clutch, the friction brake, and the mesh brake, and an electromagnetic control actuator is used when applying the electromagnetic clutch and the electromagnetic brake. In this embodiment, the friction clutch (mesh clutch) and the friction brake (mesh brake) are controlled by using the hydraulic control actuator.

In addition, a third accommodating chamber A3 is formed inside the casing 17 in a space enclosed by the partition wall 18*a* of the front case 18 and the partition wall 19*a* of the center case 19. A stepless transmission 58 is provided in the third accommodating chamber A3. The stepless transmission 58 is for steplessly changing the rotational speed of the primary shaft 15 to transmit to a secondary shaft 59, and is arranged between the engine 11 and the forward/reverse switching device 51.

The stepless transmission 58 is a belt-type stepless transmission and has the above-described primary shaft 15 and secondary shaft 59, and the primary shaft 15 and the secondary shaft 59 are rotatably supported on the partition walls 18*a* and 19*a* so as to be parallel to each other. A primary pulley 60 is provided on the primary shaft 15 so as to be integrally rotatable, and a secondary pulley 61 is provided on the secondary shaft 59 so as to be integrally rotatable. An endless belt 62 is mounted on the primary pulley 60 and the secondary pulley 61.

The primary pulley 60 has a fixed sieve 60*a* integral with the primary shaft 15 and a movable sieve 60*b* movable in an axial direction of the primary shaft 15, and the endless belt 62 is mounted therebetween. A first hydraulic servomechanism 63 for moving the movable sieve 60*b* in the axial direction of the primary shaft 15 to allow the same to approach and leave the fixed sieve 60*a* is provided. On the other hand, the secondary pulley 61 has a fixed sieve 61*a* integral with the secondary shaft 59 and a movable sieve 61*b* movable in an axial direction of the secondary shaft 59, and the endless belt 62 is mounted on them. A second hydraulic servomechanism 64 for moving the movable sieve 61*b* in the axial direction of the secondary shaft 59 to allow the same to approach and leave the fixed sieve 61*a* is provided. A gear ratio can be steplessly changed by changing engaging positions of the primary pulley 60 and the secondary pulley 61 with respect to the belt 62 by the hydraulic servomechanisms 63 and 64, respectively.

Further, a gear transmission device 65 with which torque of the secondary shaft 59 is transmitted and a differential 66 are provided inside the casing 17, and a wheel 68 is coupled to the differential 66 through a drive shaft 67.

An electronic control unit (ECU) 71 for integrally controlling an entire vehicle is provided on the vehicle. That is to say, an ignition switch 72, an accelerator opening sensor 73, a brake stroke sensor 74, an engine rotational number sensor 75, a throttle opening sensor 76, a rotational number sensor 77 of the input shaft 14, a rotational number sensor 78 of the primary shaft 15, a rotational number sensor 79 of the secondary shaft 59, and a shift position sensor 80 are provided, and detection signals thereof are input to the ECU 71.

Also, a hydraulic control device 81 for controlling the above-described oil pump 22, forward/reverse switching device 51 and stepless transmission 58 is provided on the vehicle and can be controlled by the ECU 71. To the hydraulic control device 81, a first oil suction path (fluid suction path) 83, which is coupled to an oil retaining unit (fluid retaining unit, such as an oil pan) 82, is coupled, and a first oil exhaust path (fluid exhaust path) 85, which is coupled to an oil supplying unit (fluid supplying unit, such as the forward/reverse switching device 51 and a hydraulic control unit of the stepless transmission 58) 84, is coupled. Also, the hydraulic control device 81 is coupled to the oil pump 22 through the path switching device 86 and the control valve 87 for controlling the oil pump 22.

That is to say, as shown in FIGS. 1 and 2, on the oil pump 22, the first oil passage 32, the first communication hole 29, the coupling holes 35*a* and 35*c*, the coupling grooves 34*a* and 34*c*, and the coupling holes 42*a* to 42*h* are provided as the first fluid path through which the oil as the fluid flows into and out from the fluid chambers 41*a* to 41*h*, and the second oil passage 33, the second communication holes 30*a* and 30*b*, the coupling holes 35*b* and 35*d*, the coupling grooves 34*b* and 34*d* and the coupling holes 42*a* to 42*h* are provided as the second fluid path. The path switching device 86 switches the inflow direction and the outflow direction of the fluid in the first and second fluid paths according to the difference in pressure between the first and second fluid paths. Also, the control valve 87 controls the flow amount of the oil in the oil circulation path 88.

In the path switching device 86, a housing 91 has a hollow shape, and a first port 92 communicating with the first oil passage 32 as the first fluid path and a second port 93 communicating with the second oil passage 33 as the second fluid path are formed. Also, in the housing 91, a suction port 94 communicating with the second oil suction path 89 and two exhaust ports 95 and 96 communicating with the second oil exhaust path 90 are formed. In the housing 91, a spool 97 as the moving body is movably supported, and on the spool 97, a valve unit 97*a* enabling communication and blocking between the first port 92 and the suction and exhaust ports 94 and 95, and a valve unit 97*b* enabling the communication and the blocking between the second port 93 and the suction and exhaust ports 94 and 96 are formed. Further, in the housing 91, a first pressure port 99 communicating with a first branched path 98 branched from the first oil passage 32 as the first fluid path and a second pressure port 101 communicating with a second branched path 100 branched from the second oil passage 33 as the second fluid path are formed on each end portion in the axial direction. A valve unit 97*c* on which the oil pressure from the first branched path 98 acts and a valve unit 97*d* on which the oil pressure from the second branched path 100 acts are formed on the spool 97.

Therefore, the path switching device 86 can switch the inflow direction and the outflow direction of the fluid in the first and second fluid paths by the movement of the spool 97 according to the difference in pressure between the first fluid path (first oil passage 32) and the second fluid path (second oil passage 33). That is to say, when the oil pressure in the first oil passage 32 as the first fluid path is higher than that in the second oil passage 33 as the second fluid path, the oil pressure in the first oil passage 32 acts from the first pressure port 99 through the first branched path 98 on the valve unit 97*c*, so that the spool 97 moves to right in FIG. 1 to stop at the first movement position. Then, the first port 92 communicates with the exhaust port 95 by the valve unit 97*a* and the second port 93 communicates with the suction port 94 by the valve unit 97*b*, and the oil pressure in the second oil suction path 89 flows through the suction port 94 and the second port 93 to the second oil passage 33 and the oil pressure in the first oil passage 32 flows through the first port 92 and the exhaust port 95 to the second oil exhaust path 90.

On the other hand, when the oil pressure in the second oil passage 33 is higher than that in the first oil passage 32, the oil pressure in the second oil passage 33 acts from the second pressure port 101 through the second branched path 100 on the valve unit 97*d*, so that the spool 97 moves to left in FIG. 1 to stop at the second movement position. Then, the first port 92 communicates with the exhaust port 94 by the valve unit 97*a* and the second port 93 communicates with the exhaust port 96 by the valve unit 97*b*, and the oil pressure in the oil suction path 83 flows through the suction port 94 and the first port 92 to the first oil passage 32 and the oil pressure in the second oil passage 33 flows through the second port 93 and the exhaust port 96 to the oil exhaust path 85.

Also, the second oil exhaust path 90 branches into the first oil exhaust path 85 and the oil circulation path 88, and a part of the oil exhausted from the oil pump 22 flows through the first oil exhaust path 85 to the oil supplying unit 84 and the rest flows to the oil circulation path 88. The oil flowing to the oil circulation path 88 joins the oil flowing from the first oil suction path 83 and is returned to the second oil suction path 89. The control valve 87 is provided on the oil circulation path 88. The control valve 87 is a flow amount adjusting valve for adjusting the flow amount of the oil flowing through the oil circulation path 88 by adjusting opening thereof. An amount of oil to be supplied to the oil supplying unit 84 changes a little according to operating condition but substantially constant, so that the control valve 87 can adjust a discharge amount from the oil pump 22 by adjusting the flow amount of the oil flowing through the oil circulation path 88.

Herein, operation of the above-described oil pump 22 of this embodiment is described in detail.

In the oil pump 22 of this embodiment, as shown in FIGS. 1 to 3, when the torque of the engine 11 is transmitted from the crankshaft 12 through the dumper device 13 to the input shaft 14, the torque of the input shaft 14 is transmitted from the rotary valve 27 through the rotating plate 24 to the first rotating member 25 in the oil pump 22. At that time, by adjusting the discharge amount from the oil pump 22 by the control valve 87, it is possible to limit the movement of each of the pistons 38*a* to 38*h*, and to transmit the torque of the first rotating member 25 from the cam 26 through the pistons 38*a* to 38*h* to the second rotating member 36 to transmit from the second rotating member 36 through the supporting plate 44 to the output shaft 45.

That is to say, in the oil pump 22, the first and second rotating members 25 and 36 rotate in a counterclockwise direction in FIG. 2 (a direction indicated by an arrow in FIG. 2), and when a rotational speed $V_1$ of the first rotating member 25 is higher than a rotational speed $V_2$ of the second rotating member 36, the second rotating member 36 rotates in a direction opposite to that of the first rotating member 25, that is to say, in a clockwise direction. Therefore, for example, from a state shown in FIG. 2, the roller 39*f* moves by rolling from the cam surface 26*d* to the cam surface 26*a*, and the piston 38*f* moves outward from the cylinder 37*f* and the oil chamber 41*f* is expanded. At that time, the oil chamber 41*f* communicates with the coupling hole 42*f*, the coupling groove 34*b*, the coupling hole 35*b*, the second communication hole 30*a* and the second oil passage 33. On the other hand, from the state shown in FIG. 2, for example, the roller 39*h* moves by rolling from the cam surface 26*a* to the cam surface 26*b*, so that the piston 38*h* moves inward of the cylinder 37*h* and the oil chamber 41*h* is contracted. At that time, the oil chamber 41*h* communicates with the coupling hole 42*h*, the coupling groove 34*a*, the coupling hole 35*a*, the first communication hole 29 and the first oil passage 32.

In this case, suction force acts from the oil chamber 41*f* to the second oil passage 33 due to the expansion of the oil chamber 41*f*, and on the other hand, compression force acts from the oil chamber 41*h* to the first oil passage 32 due to the contraction of the oil chamber 41*h*. Therefore, as described above, in the path switching device 86, the oil pressure in the first oil passage 32 becomes higher than that in the second oil passage 33 and the spool 97 moves to the first movement position. Then, the oil from the oil circulation path 88 flows to the second oil suction path 89 and the oil in the oil retaining unit 82 also flows through the first oil suction path 83 to the second oil suction path 89, flows through the suction port 94 and the second port 93 to the second oil passage 33, and is sucked into the oil chamber 41*f*. On the other hand, the oil in the oil chamber 41*h* flows from the first oil passage 32 through the first port 92 and the exhaust port 95 to the second oil exhaust path 90, and a part thereof is discharged through the first oil exhaust path 85 to the oil supplying unit 84 and the rest flows to the oil circulation path 88.

At that time, in a case in which the control valve 87 is fully opened, the flow amount of the oil flowing through the oil circulation path 88 is not limited and flow resistance is small, and the flow resistance of the oil discharged from the oil chamber 41*h* to the second oil exhaust path 90 is also small. Therefore, when the roller 39*h* of the piston 38*h* moves by rolling from the cam surface 26*a* to the cam surface 26*b*, the resistance when the piston 38*h* moves inward of the cylinder 37*h* is also small, so that the second rotating member 36 easily rotates in the direction opposite to that of the first rotating member 25 (in the clockwise direction in FIG. 2). As a result, the torque is hardly transmitted from the input shaft 14 through the oil pump 22 to the output shaft 45 and the output shaft 45 does not rotate, then the vehicle stops. On the other hand, when the opening of the control valve 87 is made gradually smaller, the flow resistance of the oil flowing through the oil circulation path 88 increases and the flow resistance of the oil discharged from the oil chamber 41*h* to the second oil exhaust path 90 also increases, the resistance when the piston 38*h* moves inward of the cylinder 37*h* also increases, the torque transmitted from the input shaft 14 through the oil pump 22 to the output shaft 45 also increases, then the output shaft 45 starts rotating, and the vehicle starts moving. That is to say, the oil pump 22 can also serve as a starting device by adjustment of the opening of the control valve 87.

Also, when the control valve 87 is fully closed, the flow amount of the oil flowing through the oil circulation path 88 becomes 0 and entire oil discharged from the oil pump 22 is supplied to the oil supplying unit 84, and consumption energy of the oil pump 22 is suppressed.

Meanwhile, although only the operation of the piston 38*f*, the roller 39*f*, and the oil chamber 41*f*, and the piston 38*f*, the cylinder 37*f* and the oil chamber 41*h* is described in the operational description of the above-described oil pump 22, all of the pistons 38*a* to 38*h*, cylinders 37*a* to 37*h* and oil chambers 41*a* to 41*h* operate similarly by the cam 26.

When the torque of the input shaft 14 is transmitted through the oil pump 22 to the output shaft 45, the torque of the output shaft 45 is transmitted through the forward/reverse switching device 51 to the stepless transmission 58 and is decelerated by a predetermined gear ratio set herein. The torque decelerated by the stepless transmission 58 is transmitted through the gear transmission device 65 to the differential 66 and is transmitted through the drive shaft 67 to the wheel 68.

On the other hand, when an engine brake acts on the vehicle, in the oil pump 22, although the first and second rotating members 25 and 36 rotate in the counterclockwise direction in FIG. 2 (the direction indicated by the arrow in FIG. 2), the rotational speed $V_1$ of the first rotating member 25 becomes lower than the rotational speed $V_2$ of the second rotating member 36. More specifically, the first rotating member 25 rotates in the direction opposite to that of the second rotating member 36, that is to say, in the counterclockwise direction. Therefore, for example, the roller 39*f* moves by rolling from the cam surface 26*d* to the cam surface 26*c*, so that the piston 38*f* moves outward from the cylinder 37*f* and the oil chamber 41*f* is expanded. At that time, the oil chamber 41*f* communicates with the coupling hole 42*f*, the coupling groove 34*c*, the coupling hole 35*c*, the first communication hole 29, and the first oil passage 32. On the other hand, for example, the roller 39*h* moves by rolling from the cam surface 26*a* to the cam surface 26*d*, so that the piston 38*h* moves inward of the cylinder 37*h* and the oil chamber 41*h* is contracted. At that time, the oil chamber 41*h* communicates with the coupling hole 42*h*, the coupling groove 34*b*, the coupling hole 35*b*, the second communication hole 30*a*, and the second oil passage 33.

In this case, the suction force acts from the oil chamber 41*f* to the first oil passage 32 due to the expansion of the oil chamber 41*f*, on the other hand, the compression force acts from the oil chamber 41*h* to the second oil passage 33 due to the contraction of the oil chamber 41*h*. Therefore, as described above, in the path switching device 86, the oil pressure in the second oil passage 33 becomes higher than that in the first oil passage 32 and the spool 97 moves to the second movement position. Then, the oil from the oil circulation path 88 flows to the second oil suction path 89 and the oil in the oil retaining unit 82 flows from the first oil suction path 83 to the second oil suction path 89, flows through the suction port 94 and the first port 92 to the first oil passage 32, and is sucked into the oil chamber 41*f*. On the other hand, the oil from the oil chamber 41*h* flows from the second oil passage 33 through the second port 93 and the exhaust port 96 to the second oil exhaust path 90, and a part thereof is discharged through the first oil exhaust path 85 to the oil supplying unit 84 and the rest flows to the oil circulation path 88.

In this manner, in the hydraulic apparatus according to the first embodiment, the first and second rotating members 25 and 36 are provided so as to be relatively rotatable with the same central axis O, the cam 26 is provided on the first rotating member 25, the pistons 38*a* to 38*h* are arranged on the second rotating member 36 so as to be opposed to the cam 25, the pistons 38*a* to 38*h* are pressed against the cam 26 so as to contact by the compression coil springs 40*a* to 40*h*, respectively, the oil chambers 41*a* to 41*h* of which volumes are expanded and contracted according to the movements of the pistons 38*a* to 38*h* are provided on the second rotating member 36, the first fluid path (first oil passage 32) and the second fluid path (second oil passage 33) through which the oil flows into and out from the oil chambers 41*a* to 41*h* are provided, and the path switching device 86 for switching the inflow direction and the outflow direction of the oil in the first and second fluid paths according to the difference in pressure between the first and second fluid paths is provided.

Therefore, by discharging the oil to a predetermined oil passage (second oil exhaust path 90) regardless of the rotational directions of each of the rotating members 25 and 36 due to the switch of the inflow direction and the outflow direction of the oil according to the difference in pressure between the first and second fluid paths by the path switching device 86, the oil can be appropriately supplied to the forward/reverse switching device 51 and the hydraulic control unit of the stepless transmission 58 as the oil supplying unit 84, and burning of the clutch and occurrence of shock when engaging in the forward/reverse switching device 51, and belt breakage in the stepless transmission 58 can be prevented. Also, since a check valve is not used in the oil path, the pressure loss is suppressed, so that occurrence of cavitation when sucking the oil and the operational inadequacy (cum nose jumping phenomenon) of the pistons 38*a* to 38*h* are suppressed, and further the mechanical efficiency can be improved. Further, the simple structure can be obtained without requiring special control and actuator.

Also, in the first embodiment, the spool 97 as the moving body for switching the inflow direction and the outflow direction of the oil in the first and second fluid paths by moving according to the difference in pressure between the first fluid path (first oil passage 32) and the second fluid path (second oil passage 33) is provided as the path switching device 86, and the spool 97 is made movable to the first movement position for setting the first fluid path to the outflow direction of the oil and switching the second fluid path to the inflow direction of the oil, and to the second movement position for setting the first fluid path to the inflow direction of the oil and switching the second fluid path to the outflow direction of the oil.

Therefore, by moving the spool 97 to the first and second movement positions according to the difference in pressure between the first and second oil passages 32 and 33, the inflow direction of the oil and the outflow direction of the oil in the first and second oil passages 32 and 33 can be switched, so that the oil can be appropriately sucked and discharged with the simple structure.

Also, in the first embodiment, as the path switching device 86, the first port 92 communicating with the first oil passage 32 as the first fluid path and the second port 93 communicating with the second oil passage 33 as the second fluid path are provided and the suction port 94 communicating with the oil suction path 83 and the exhaust ports 95 and 96 communicating with the oil exhaust path 85 are provided in the housing 91, and the communication relationship between the first and second ports 92 and 93 and the suction port 94 and the exhaust ports 95 and 96 are made switchable by the spool 97, and the first pressure port 99 with which the pressure in the first oil passage 32 acts on the spool 97 and the second pressure port 101 with which the pressure in the second oil passage 33 acts on the spool are provided.

Therefore, by allowing the oil pressures in the first and second oil passages 32 and 33 to act on the spool 97 through the pressure ports 99 and 101, the spool 97 moves to the first or second movement position according to the difference in pressure therebetween, and the communication relationship between the first and second ports 92 and 93 and the suction port 94 and the exhaust ports 95 and 96 can be switched by the movement of the spool 97, so that the oil can be appropriately sucked and discharged.

Also, in the first embodiment, the path switching device 86 is coupled to the oil retaining unit 82 through the oil suction path 83 and is coupled to the oil supplying unit 84 through the oil exhaust path 85, and the control valve 87 for controlling the flow amount of the oil is provided on the oil exhaust path 85. Therefore, by adjusting the flow amount of the oil in the oil exhaust path 85 by the control valve 87, a torque transmission amount between the first and second rotating members 25 and 36 can be adjusted, so that the oil can be appropriately sucked and discharged, and the torque can be appropriately transmitted between the first and second rotating members 25 and 36.

Also, in the first embodiment, the input shaft 14 is coupled to the first rotating member 25, the output shaft 45 is coupled to the second rotating member 36, the pistons 38*a* to 38*h* reciprocate by the difference in rotational speeds between the first and second rotating members 25 and 36, and the pressures in the fluid chambers 41*a* to 41*h* change, thereby the oil is sucked and discharged through the first and second fluid paths. Therefore, an appropriate oil discharge amount can be ensured based on the difference in rotational speed between the first and second rotating members 25 and 36.

Second Embodiment

Figure 4:
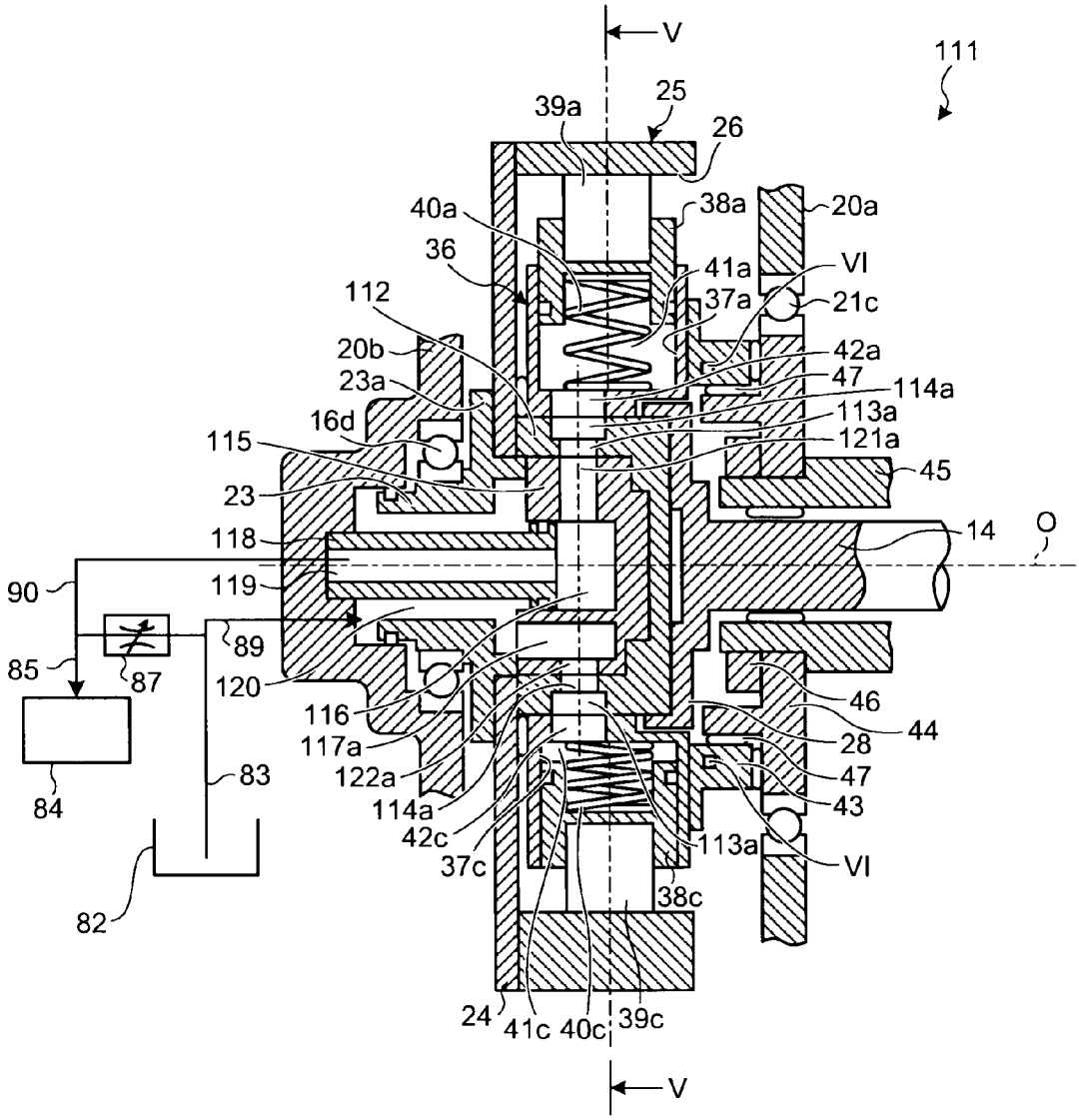
FIG. 4 is a schematic configuration diagram of the oil pump showing the hydraulic apparatus according to a second embodiment of the present invention.
Figure 5:
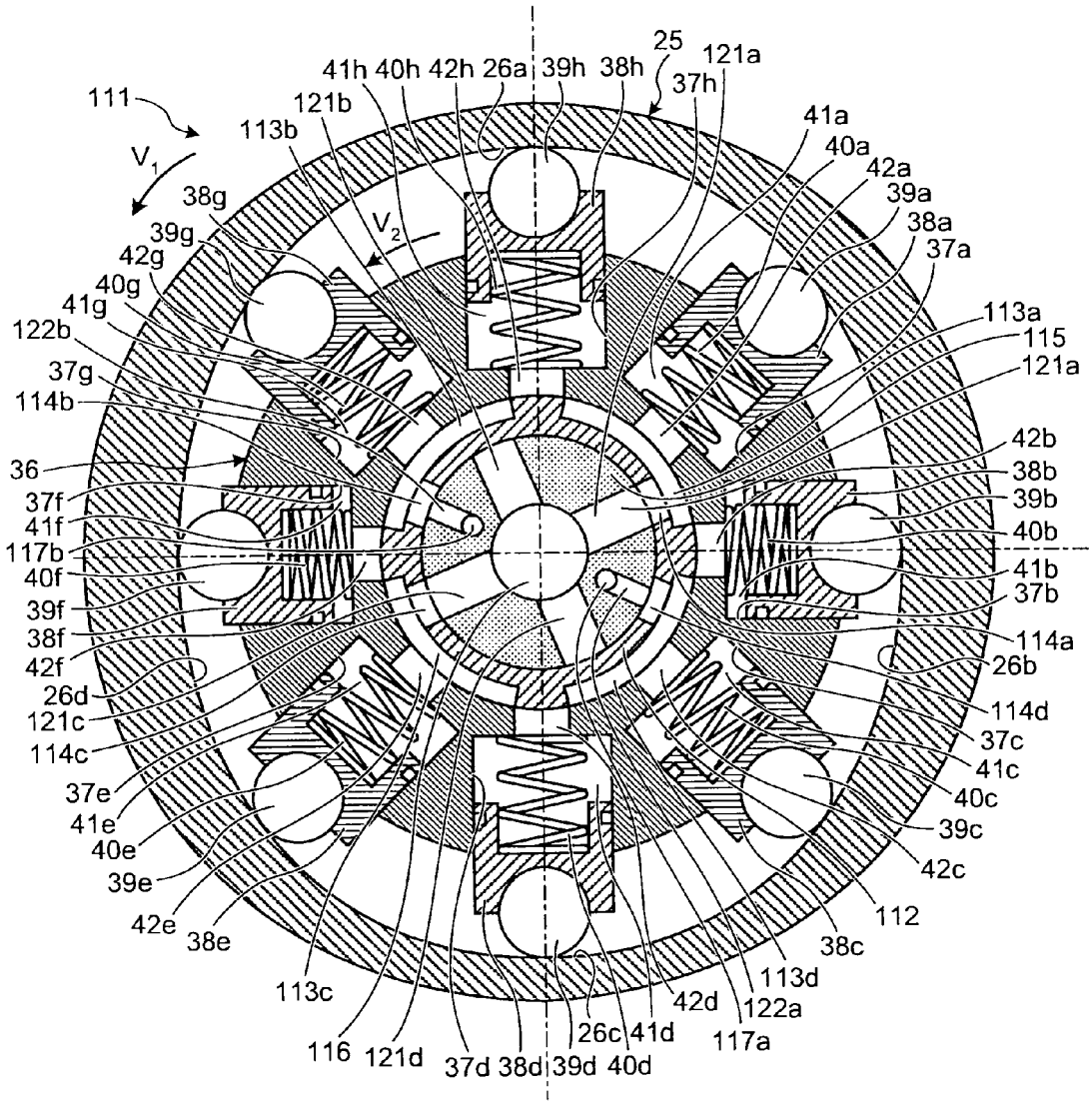
FIG. 5 is a cross-sectional view taken along line V-V of FIG. 4.
Figure 6:
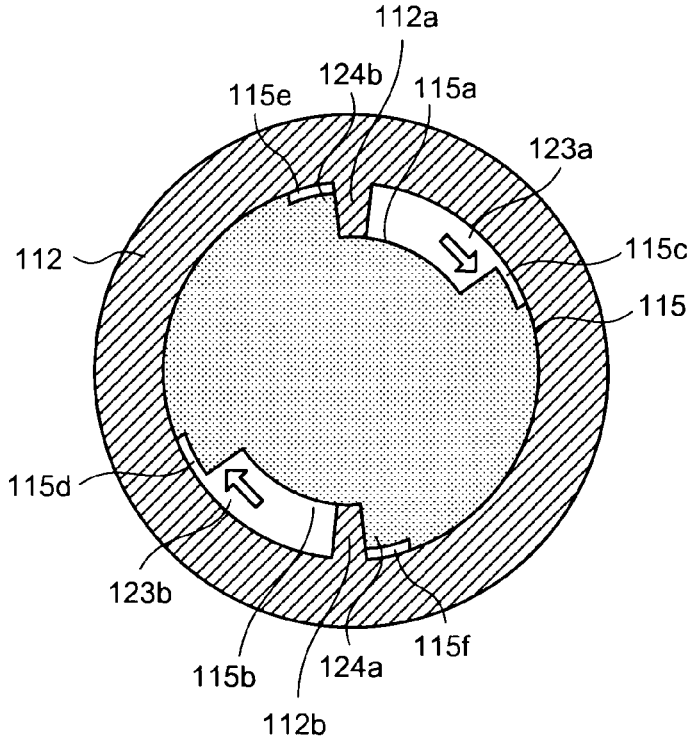
FIG. 6 is a cross-sectional view taken along line VI-VI of FIG. 4.
Figure 7:
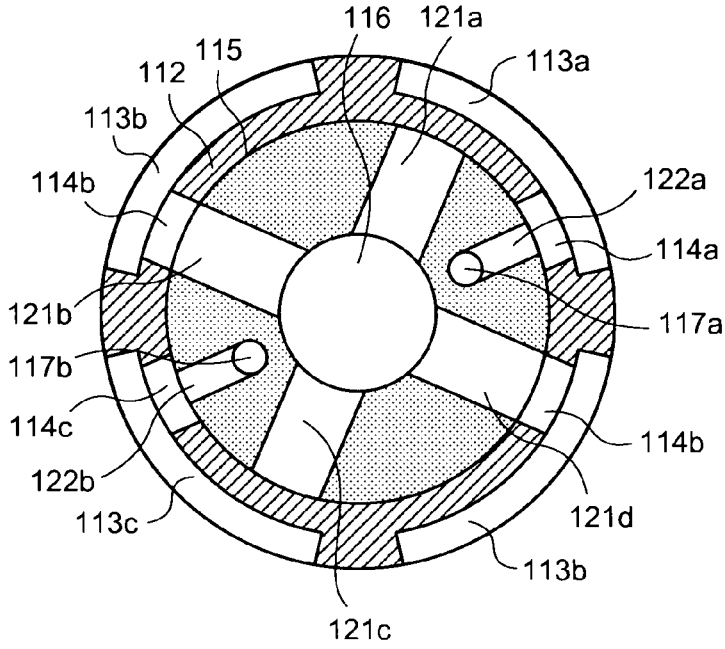
FIG. 7 is a cross-sectional view of a rotating body in the oil pump of the first embodiment at the time of path switch.
Figure 8:
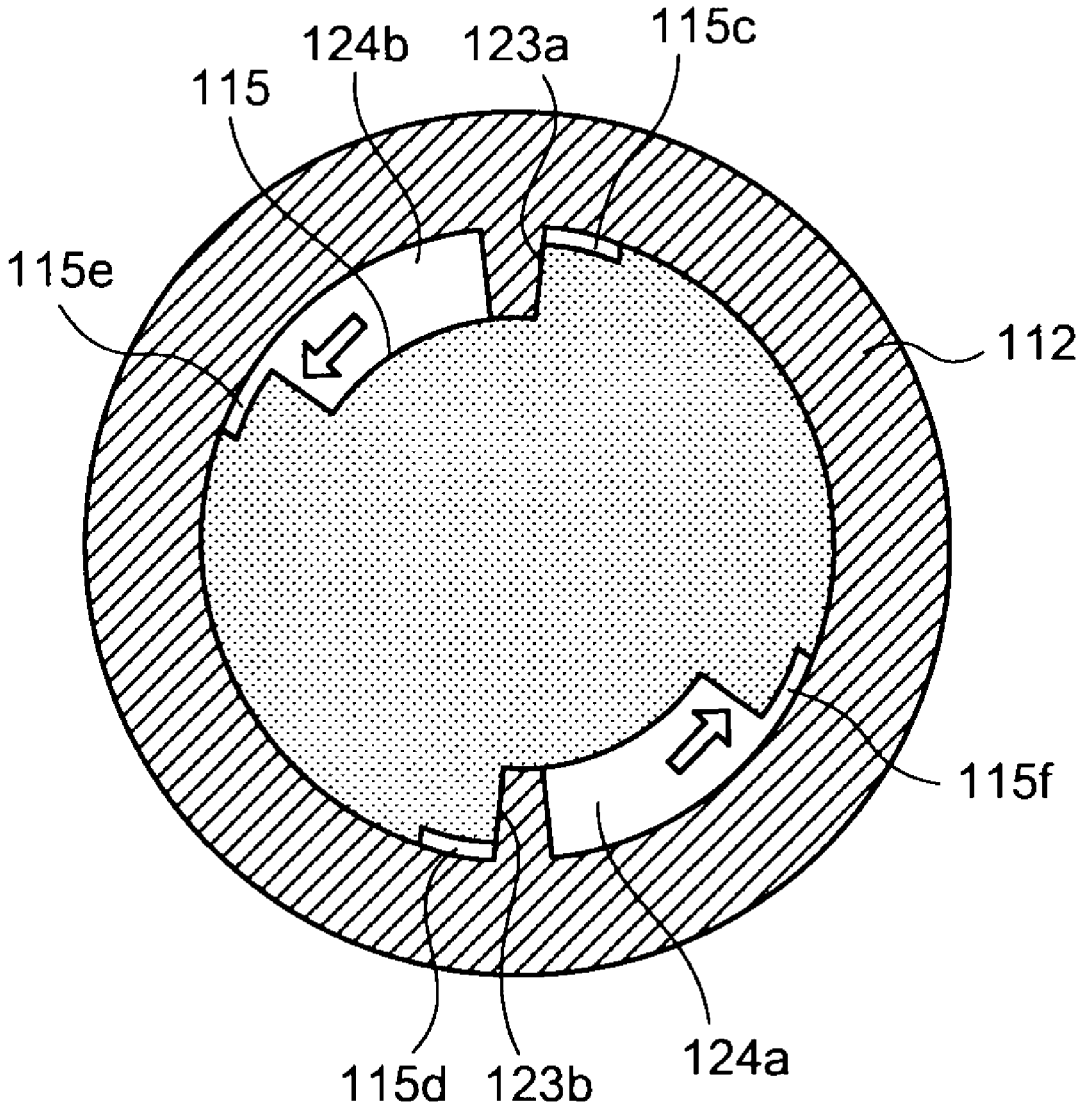
FIG. 8 is a cross-sectional view showing a rotational position of the rotating body in the oil pump of the first embodiment.

FIG. 4 is a schematic configuration diagram of the oil pump showing the hydraulic apparatus according to a second embodiment of the present invention, FIG. 5 is a cross-sectional view taken along line V-V of FIG. 4, FIG. 6 is a cross-sectional view taken along line VI-VI of FIG. 4, FIG. 7 is a cross-sectional view of the rotating body in the oil pump of the second embodiment at the time of switching the path, and FIG. 8 is a cross-sectional view showing the rotational position of the rotating body in the oil pump of the first embodiment. Meanwhile, the same reference numeral is given to the member having the similar function as that described in the above-described embodiment and the description thereof is not repeated.

In the second embodiment, as shown in FIGS. 4 to 6, an oil pump 111 as the hydraulic apparatus of this embodiment is provided inside the casing in the space enclosed by the two partition walls 20*a* and 20*b*. In the oil pump 111, the sleeve 23 is rotatably supported on the partition wall 20*b* of the rear case 20 through the bearing 16*d*, the rotating plate 24 is fixed to the sleeve 23, and the first rotating member 25 is fixed to the rotating plate 24. The cam 26 having the cam surfaces 26*a*, 26*b*, 26*c* and 26*d* is provided on the inner peripheral surface of the first rotating member.

Also, a cylindrical rotary valve 112 is joined to the rotating plate 24, and the end plate 28 of the input shaft 14 fits an outer peripheral surface of the rotary valve 112 to be integrally joined. On the rotary valve 112, four coupling grooves 113*a*, 113*b*, 113*c* and 113*d* are formed on the outer peripheral surface thereof in the peripheral direction, and the coupling holes 114*a*, 114*b*, 114*c* and 114*d* communicating with the coupling grooves 113*a*, 113*b*, 113*c* and 113*d*, respectively, are formed on the inner peripheral surface thereof.

The second rotating member 36 rotatably fits on the outer peripheral surface of the rotary valve 112. On the second rotating member 36, the eight cylinders 37*a* to 37*h* are formed on the outer peripheral portion thereof at regular intervals in the peripheral direction, and the pistons 38*a* to 38*h* are movably supported by the cylinders 37*a* to 37*h*, respectively. The rollers 39*a* to 39*h* are mounted on the tip ends of the pistons 38*a* to 38*h*, respectively. Also, the compression coil springs 40*a* to 40*h* are interposed in the cylinders 37*a* to 37*h*, respectively, and the rollers 39*a* to 39*h* of the cylinders 37*a* to 37*h*, respectively, are pressed against the cam surfaces 26*a*, 26*b*, 26*c* and 26*d* of the cam 26 by the biasing force of each of the compression coil springs 40*a* to 40*h*. The oil chambers 41*a* to 41*h* are formed between the pistons 38*a* to 38*h* and the cylinders 37*a* to 37*h*, respectively. The oil chambers 41*a* to 41*h* can communicate with the coupling grooves 113*a*, 113*b*, 113*c* and 113*d* through the coupling holes 42*a* to 42*h*.

Also, the coupling tube 43 is fixed to the second rotating member 36, and this fits the supporting plate 44 joined to the output shaft 45 by the spline 47, so that the coupling tube 43 and the supporting plate 44, that is to say, the second rotating member 36 and the output shaft 45 are coupled so as to be integrally rotatable.

In the oil pump 111 of this embodiment, the coupling holes 114*a* and 114*c*, the coupling grooves 113*a* and 113*c*, and the coupling holes 42*a* to 42*h* are provided as the first fluid path through which the oil as the fluid flows into or out from the fluid chambers 41*a* to 41*h*, and the coupling holes 114*b* and 114*d*, the coupling grooves 113*b* and 113*d*, and the coupling holes 42*a* to 42*h* are provided as the second fluid path. A rotating body 115 composing the path switching device concentrically rotatably fits an inner peripheral portion of the rotary valve 112. The rotating body 115 switches the inflow direction and the outflow direction of the fluid in the first and second fluid paths according to the difference in pressure between the first and second fluid paths. Also, the control valve 87 controls the flow amount of the oil in the oil circulation path 88.

In the rotating body 115, an exhaust chamber 116 is formed from one end face to a central portion thereof, and two suction chambers 117*a* and 117*b* are formed on an outer peripheral side of the exhaust chamber 116. A cylindrical holder 118 passes through the sleeve 23 and the end portion thereof fits the exhaust chamber 116 and is fixed, thereby forming an exhaust oil passage 119 communicating from an inside the holder 118 to the exhaust chamber 116 is formed and a suction oil passage 120 communicating from a portion between the sleeve 23 and the holder 118 to the suction chambers 117*a* and 117*b*. The exhaust chamber 116 communicates with the second oil exhaust path 90 through the exhaust oil passage 119, and can communicate with the coupling holes 114*a* and 114*c* as the first fluid path or the coupling holes 114*b* and 114*d* as the second fluid path through the coupling holes 121*a*, 121*b*, 121*c* and 121*d*. Also, the suction chambers 117*a* and 117*b* communicate with the second oil suction path 89 through the suction oil passage 120, and can communicate with the coupling holes 114*a* and 114*c* as the first fluid path or the coupling holes 114*b* and 114*d* as the second fluid path through the coupling holes 122*a* and 122*b*.

Also, first pressure chambers 123*a* and 123*b* with which the coupling holes 114*a* and 114*c* as the first fluid path communicate, respectively, are provided between the rotary valve 112 and the rotating body 115, and second pressure chambers 124*a* and 124*b* with which the coupling holes 114*b* and 114*d* as the second fluid path communicate, respectively, are provided between the rotary valve 112 and the rotating body 115. That is to say, two notch portions 115*a* and 115*b* are formed on the outer peripheral portion of the rotating body 115 at regular intervals in the peripheral direction, on the other hand, projecting portions 112*a* and 112*b* engaging with the notch portions 115*a* and 115*b*, respectively, are formed on the outer peripheral portion of the rotary valve 112. Therefore, although the rotating body 115 can rotate relative to the rotary valve 112, end faces of the notch portions 115*a* and 115*b* abut the projecting portions 112*a* and 112*b* of the rotary valve 112, respectively, so that a rotation area thereof is regulated. Then, the first pressure chambers 123*a* and 123*b* and the second pressure chambers 124*a* and 124*b* are divided by the notch portions 115*a* and 115*b*, respectively. The first pressure chambers 123*a* and 123*b* communicate with the coupling holes 114*a* and 114*c* through the coupling grooves 115*c* and 115*d*, respectively, and the second pressure chambers 124*a* and 124*b* communicate with the coupling holes 114*b* and 114*d* through the coupling grooves 115*e* and 115*f*, respectively.

Therefore, the inflow direction and the outflow direction of the fluid in the first and second fluid paths can be switched by the rotation of the rotating body 115 according to the difference in pressure between the first fluid path (coupling holes 114*a* and 114*c*) and the second fluid path (coupling holes 114*b* and 114*d*). That is to say, when the oil pressure in the coupling holes 114*a* and 114*c* as the first fluid path is higher than that in the coupling holes 114*b* and 114*d* as the second fluid path, the oil pressure in the coupling holes 114*a* and 114*c* acts on the first pressure chambers 123*a* and 123*b* through the communication grooves 115*c* and 115*d*, so that the rotating body 115 moves by rolling in the clockwise direction in FIGS. 5 and 6 to stop at the first position at which the end faces of the notch portions 115*a* and 115*b* abut the projecting portions 112*a* and 112*b*, respectively. Then, the coupling holes 121*a* and 121*c* communicate with the coupling holes 114*a* and 114*c*, respectively, and the coupling holes 122*a* and 122*b* communicate with the coupling holes 114*b* and 114*d*, respectively, so that the oil pressure in the second oil suction path 89 flows through the suction oil passage 120 and the suction chambers 117*a* and 117*b* to the second fluid path, and the oil pressure in the first fluid path flows through the exhaust chamber 116 and the exhaust oil passage 119 to the second oil exhaust path 90.

On the other hand, when the oil pressure in the coupling holes 114*b* and 114*d* as the second fluid path is higher than that in the coupling holes 114*a* and 114*c* as the first fluid path, as shown in FIGS. 7 and 8, the oil pressures in the coupling holes 114*b* and 114*d* act on the second pressure chambers 124*a* and 124*b* through the communication grooves 115*e* and 115*f*, so that the rotating body 115 moves by rolling in the counterclockwise direction in FIGS. 7 and 8 to stop at the second position at which the end faces of the notch portions 115*a* and 115*b* abut the projecting portions 112*a* and 112*b*. Then, the coupling holes 121*b* and 121*d* communicate with the coupling holes 114*b* and 114*d*, respectively, and the coupling holes 122*a* and 122*b* communicate with the coupling holes 114*a* and 114*c*, respectively, so that the oil pressure in the second oil suction path 89 flows through the suction oil passage 120 and the suction chambers 117*a* and 117*b* to the first fluid path, and the oil pressure in the second fluid path flows through the exhaust chamber 116 and the exhaust oil passage 119 to the second oil exhaust path 90.

Also, the second oil exhaust path 90 branches into the first oil exhaust path 85 and the oil circulation path 88, and a part of the oil exhausted from the oil pump 22 flows through the first oil exhaust path 85 to the oil supplying unit 84 and the rest flows to the oil circulation path 88. The oil flowing to the oil circulation path 88 joins the oil flowing from the first oil suction path 83 and is returned to the second oil suction path 89. The control valve 87 is provided on the oil circulation path 88. The control valve 87 is the flow amount adjusting valve, and the discharge amount from the oil pump 111 can be adjusted by adjusting the flow amount of the oil flowing through the oil circulation path 88 by adjusting the opening thereof.

Herein, the operation of the above-described oil pump 111 of this embodiment is described in detail.

In the oil pump 111 of this embodiment, as shown in FIGS. 4 to 8, the first and second rotating members 25 and 36 rotate in a counterclockwise direction in FIG. 5 (a direction indicated by an arrow in FIG. 5), and when the rotational speed $V_1$ of the first rotating member 25 is higher than the rotational speed $V_2$ of the second rotating member 36, the second rotating member 36 rotates in the direction relatively opposite to that of the first rotating member 25, that is to say, in the clockwise direction. Therefore, from a state shown in FIG. 5, for example, the roller 39*f* moves by rolling from the cam surface 26*d* to the cam surface 26*a*, so that the piston 38*f* moves outward from the cylinder 37*f* and the oil chamber 41*f* is expanded. At that time, the oil chamber 41*f* communicates with the coupling hole 42*f*, the coupling groove 113*b* and the coupling hole 114*b*. On the other hand, for example, the roller 39*f* moves by rolling from the cam surface 26*a* to the cam surface 26*b*, so that the piston 38*h* moves inward of the cylinder 37*h* and the oil chamber 41*h* is contracted. At that time, the oil chamber 41*h* communicates with the coupling hole 42*h*, the coupling groove 113*a* and the coupling hole 114*a*.

In this case, the suction force acts from the oil chamber 41*f* to the coupling hole 114*b* due to the expansion of the oil chamber 41*f*, on the other hand, the compression force acts from the oil chamber 41*h* to the coupling hole 114*a* due to the contraction of the oil chamber 41*h*. Therefore, as described above, the oil pressure in the coupling hole 114*a* becomes higher than that in the coupling hole 114*b* and the oil pressure in the coupling hole 114*a* acts on the first pressure chamber 123*a*, and the rotating body 115 rotates in a clockwise direction in FIG. 6 to move to the first position. Then, the oil from the oil circulation path 88 flows to the second oil suction path 89, and the oil in the oil retaining unit 82 flows through the first oil suction path 83 to the second oil suction path 89, passes through the suction oil passage 120 and the suction chamber 117*b*, and is sucked into the oil chamber 41*f* through the coupling hole 122*b*, the coupling hole 114*b*, the coupling groove 113*b* and the coupling hole 42*f*. On the other hand, the oil in the oil chamber 41*h* flows through the coupling hole 42*h*, the coupling groove 113*a*, the coupling hole 114*a* and the coupling hole 121*a*, flows from the exhaust chamber 116 through the exhaust oil passage 119 to the second oil exhaust path 90, and a part thereof is discharged through the first oil exhaust path 85 to the oil supplying unit 84 and the rest flows to the oil circulation path 88.

At that time, when the control valve 87 is fully opened, the flow amount of the oil flowing through the oil circulation path 88 is not limited and the flow resistance is small, and the flow resistance of the oil discharged from the oil chamber 41*h* to the second oil exhaust path 90 is also small. Therefore, when the roller 39*h* of the piston 38*h* moves by rolling from the cam surface 26*a* to the cam surface 26*b*, the resistance when the piston 38*h* moves inward of the cylinder 37*h* is also small, and the second rotating member 36 easily rotates in the direction opposite to that of the first rotating member 25 (in the clockwise direction in FIG. 5). As a result, the torque is hardly transmitted from the input shaft 14 through the oil pump 22 to the output shaft 45, then the output shaft 45 does not rotate and the vehicle stops. On the other hand, when the opening of the control valve 87 is made gradually smaller, the flow resistance of the oil flowing through the oil circulation path 88 increases, the flow resistance of the oil discharged from the oil chamber 41*h* to the second oil exhaust path 90 also increases, the resistance when the piston 38*h* moves inward of the cylinder 37*h* also increases, and the torque transmitted from the input shaft 14 through the oil pump 22 to the output shaft 45 also increases, then the output shaft 45 starts rotating and the vehicle starts moving. That is to say, the oil pump 22 is allowed to serve as the starting device by the adjustment of the opening of the control valve 87. Also, when the control valve is fully closed, the flow amount of the oil flowing through the oil circulation path 88 becomes 0, and the entire oil discharged from the oil pump 22 is supplied to the oil supplying unit 84, so that the consumption energy of the oil pump 22 is suppressed.

On the other hand, the first and second rotating members 25 and 36 rotate in the counterclockwise direction in FIG. 5 (the direction indicated by the arrow in FIG. 5), and when the rotational speed $V_1$ of the first rotating member 25 is lower than the rotational speed $V_2$ of the second rotating member 36, the first rotating member 25 rotates in the direction relatively opposite to that of the second rotating member 36, that is to say, in the counterclockwise direction. Therefore, from a state shown in FIG. 5, for example, the roller 39*f* moves by rolling from the cam surface 26*d* to the cam surface 26*c*, so that the piston 38*f* moves outward from the cylinder 37*f* and the oil chamber 41*f* is expanded. At that time, the oil chamber 41*f* communicates with the coupling hole 42*f*, the coupling groove 113*d* and the coupling hole 114*c*. On the other hand, from the state shown in FIG. 5, for example, the roller 39*h* moves by rolling from the cam surface 26*a* to the cam surface 26*d*, so that the piston 38*h* moves inward of the cylinder 37*h* and the oil chamber 41*h* is contracted. At that time, the oil chamber 41*h* communicates with the coupling hole 42*h*, the coupling groove 113*b* and the coupling hole 114*b*.

In this case, the suction force acts from the oil chamber 41*f* on the coupling hole 114*c* due to the expansion of the oil chamber 41*f*, on the other hand, the compression force acts from the oil chamber 41*h* on the coupling hole 114*b* due to the contraction of the oil chamber 41*h*. Therefore, as described above, the oil pressure in the coupling hole 114*b* becomes higher than that in the coupling hole 114*c*, so that the oil pressure in the coupling hole 114*b* acts on the second pressure chamber 124*b* and the rotating body 115 rotates in a counterclockwise direction in FIG. 8 to move to the second position. Then, the oil from the oil circulation path 88 flows to the second oil suction path 89 and the oil in the oil retaining unit 82 flows through the first oil suction path 83 to the second oil suction path 89, flows through the suction oil passage 120 and the suction chamber 117*b*, and through the coupling hole 122*b*, the coupling hole 114*c*, the coupling groove 113*c* and the coupling hole 42*f* to be sucked into the oil chamber 41*f*. On the other hand, the oil of the oil chamber 41*h* passes through the coupling hole 42*h*, the coupling groove 113*b*, the coupling hole 114*b* and the coupling hole 121*b*, and flows from the exhaust chamber 116 through the exhaust oil passage 119 to the second oil exhaust path 90, and a part thereof is discharged through the first oil exhaust path 85 to the oil supplying unit 84 and the rest flows to the oil circulation path 88.

In this manner, in the hydraulic apparatus of the second embodiment, the first and second rotating members 25 and 36 are provided so as to be relatively rotatable with the same central axis O, the cam 26 is provided on the first rotating member 25, the pistons 38*a* to 38*h* are arranged on the second rotating member 36 so as to be opposed to the cam 26, the pistons 38*a* to 38*h* are pressed against the cam 26 so as to contact by the compression coil springs 40*a* and 40*h*, respectively, the oil chambers 41*a* to 41*h* of which volumes are expanded and contracted according to the movements of the pistons 38*a* and 38*h* are provided on the second rotating member 36, the first fluid path (coupling holes 114*a* and 114*c*) and the second fluid path (coupling holes 114*b* and 114*d*) through which the oil flows into or out from the oil chambers 41*a* and 41*h* are provided, and the rotating body 115 for switching the inflow direction and the outflow direction of the oil in the first and second fluid paths according to the difference in pressure between the first and second fluid paths is provided.

Therefore, the inflow direction and the outflow direction of the oil is switched by the rotating body 115 according to the difference in pressure between the first and second fluid paths to supply the oil to the predetermined oil passage (the second oil exhaust path 90) regardless of the rotational directions of each of the rotating members 25 and 36, so that the oil can be appropriately supplied to the forward/reverse switching device 51 and the hydraulic control unit of the stepless transmission 58 as the oil supplying unit 84, thereby preventing the burning of the clutch in the forward/reverse switching device 51 and the occurrence of the shock when engaging, and the belt breakage in the stepless transmission 58. Also, since the check valve is not used in the oil path, the pressure loss is suppressed, and the occurrence of the cavitation when sucking the oil and the operational inadequacy (cam nose jumping phenomenon) of the pistons 38*a* to 38*h* are suppressed, and further, the mechanical efficiency can be improved.

Also, in the second embodiment, the rotating body 115 is concentrically rotatably supported inside the second rotating member 36, on the rotating body 115, the exhaust chamber 116 with which the second oil suction path 89 communicates and the first or second fluid path can communicate and the suction chambers 117*a* and 117*b* with which the second oil exhaust path 90 communicates and the first or second fluid path can communicate are provided, and the first pressure chambers 123*a* and 123*b* rotatable by the pressure in the first fluid path acting on the rotating body 115 and the second pressure chambers 124*a* and 124*b* rotatable by the pressure in the second fluid path acting on the rotating body 115 are provided, and the communication relationship between the first and second fluid paths and the suction chamber 116 and the exhaust chambers 117*a* and 117*b* can be switched according to the rotational position of the rotating body 115.

Therefore, space efficiency is improved and the smaller device can be obtained, and a large opening area of the oil passage can be ensured, so that it becomes possible to further suppress the pressure loss, and since the rotating body is rotatable relative to the second rotating member 36, the operational inadequacy can be prevented. The oil pressure acts on the rotating body 115 through the first pressure chambers 123*a* and 123*b* or the second pressure chambers 124*a* and 124*b* according to the difference in pressure between the coupling holes 114*a* and 114*c* and the coupling holes 114*b* and 114*d*, and the inflow direction of the oil and the outflow direction of the oil in the coupling holes 114*a* and 114*c* and the coupling holes 114*b* and 114*d* can be switched by the movement of the rotating body 115 to the first movement position and the second movement position, and the oil can be appropriately sucked and discharged with the simple structure.

Third Embodiment

Figure 9:
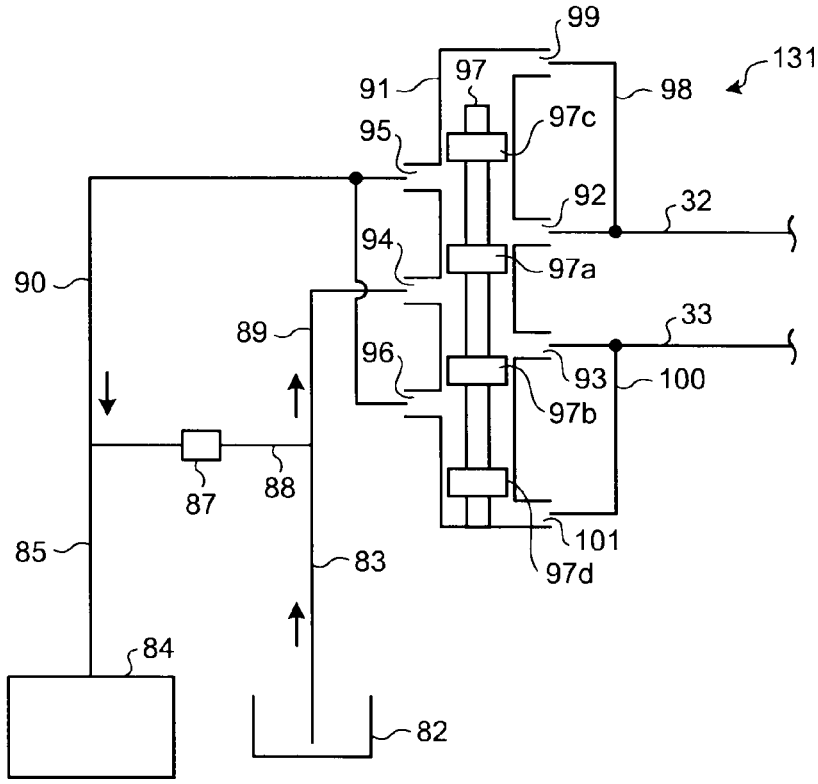
FIG. 9 is a schematic configuration diagram of a path switching device applied to the oil pump showing the hydraulic apparatus according to a third embodiment of the present invention.

FIG. 9 is a schematic configuration diagram of the path switching device applied to the oil pump showing the hydraulic apparatus according to the third embodiment of the present invention. Meanwhile, an entire structure of the hydraulic apparatus of this embodiment is substantially similar to that of the above-described first embodiment, so that this is described with reference to FIGS. 1 and 2, and the same reference numeral is given to the member having the similar function as that described in the first embodiment and the description thereof is not repeated.

The oil pump as the hydraulic apparatus of the third embodiment is composed such that the first and second rotating members 25 and 36 are supported so as to be relatively rotatable, the input shaft 14 is coupled to the first rotating member 25 through the rotary valve 27 and the cam 26 is provided on the first rotating member 25, the pistons 38*a* to 38*h* are movably supported on the second rotating member 36 and are pressed against the cam 26 by the compression coil springs 40*a* to 40*h*, respectively, and the output shaft 45 is coupled thereto, as shown in FIGS. 1 and 2. The oil chambers 41*a* to 41*h* of which volumes are expanded and contracted according to the movements of the pistons 38*a* to 38*h* are provided on the second rotating member 36, and the first fluid path (first oil passage 32) and the second fluid path (second oil passage 33) through which the oil flows into or out from the oil chambers 41*a* to 41*h* are provided.

The oil pump 22 is provided with a path switching device 131 for controlling the operation thereof, as shown in FIG. 9. In the path switching device 131, the housing 91 has the hollow shape and is arranged in the vertical direction. The first port 92 communicating with the first oil passage 32 as the first fluid path and the second port 93 communicating with the second oil passage 33 as the second fluid path are formed in the housing 91. Also, the suction port 94 communicating with the second oil suction path 89 and the two exhaust ports 95 and 96 communicating with the second oil exhaust path 90 are formed in the housing 91. Further, the first pressure port 99 communicating with the first branched path 98 branched from the first oil passage 32 and the second pressure port 101 communicating with the second branched path 100 branched from the second oil passage 33 are formed in the housing 91. The spool 97 is movably supported in the housing 91 and the four valve units 97*a*, 97*b*, 97*c* and 97*d* are formed.

In this embodiment, the spool 97 is movable to the first movement position for setting the first oil passage 32 to the outflow direction of the oil and switching the second oil passage 33 to the inflow direction of the oil, and to the second movement position for setting the first oil passage 32 to the inflow direction of the oil and switching the second oil passage 33 to the outflow direction of the oil according to the difference in pressure between the first and second oil passages 32 and 33, and is biasingly supported at the first movement position by gravity as biasing means. In this case, as shown in FIGS. 1 to 9, the housing 91 is arranged such that the first pressure port 99 and the valve unit 97*c* are positioned above and the second pressure port 101 and the valve unit 97*d* are positioned below. Also, the input shaft 14 is coupled to the first rotating member 25 and the output shaft 45 is coupled to the second rotating member 36, and when the rotational speed of the first rotating member 25 is higher than that of the second rotating member 36, a high-pressure oil passage is set as the first oil passage 32 and a low-pressure oil passage is set as the second oil passage 33.

Also, the second oil exhaust path 90 is branched into the first oil exhaust path 85 and the oil circulation path 88, and a part of the oil exhausted from the oil pump 22 flows through the first oil exhaust path 85 to the oil supplying unit 84 and the rest flows to the oil circulation path 88. The oil flowing to the oil circulation path 88 joins the oil flowing from the first oil suction path 83 and is returned to the second oil suction path 89. The control valve 87 is provided on the oil circulation path 88. The control valve 87 is the flow amount adjusting valve, and the discharge amount from the oil pump 22 can be adjusted by adjusting the flow amount of the oil flowing through the oil circulation path 88 by adjusting the opening thereof.

Therefore, in the path switching device 131, the spool 97 moves downward, that is to say, to the first movement position, in the housing 91 by the gravity thereof and stops, and at that time, the first port 92 communicates with the exhaust port 95 by the valve unit 97*a*, and the second port 93 communicates with the suction port 94 by the valve unit 97*b*. In such a state, when the oil pressure in the first oil passage 32 is higher than that in the second oil passage 33 as the second fluid path, the oil pressure in the first oil passage 32 acts from the first pressure port 99 through the first branched path 98 on the valve unit 97*c*, so that the spool 97 is held at the first movement position. Therefore, the oil pressure in the second oil suction path 89 flows through the suction port 94 and the second port 93 to the second oil passage 33, and the oil pressure in the first oil passage 32 flows through the first port 92 and the exhaust port 95 to the second oil exhaust path 90.

On the other hand, when the oil pressure in the second oil passage 33 becomes higher than that in the first oil passage 32, the oil pressure in the second oil passage 33 acts from the second pressure port 101 through the second branched path 100 on the valve unit 97*d*, so that the spool 97 rises against the gravity and moves to the second movement position to stop. Therefore, the first port 92 communicates with the exhaust port 94 by the valve unit 97*a* and the second port 93 communicates with the exhaust port 96 by the valve unit 97*b*, and the oil pressure in the second oil suction path 89 flows through the suction port 94 and the first port 92 to the first oil passage 32, and the oil pressure in the second oil passage 33 flows through the second port 93 and the exhaust port 96 to the second oil exhaust path 90.

In this manner, in the hydraulic apparatus of the third embodiment, the spool 97 for switching the inflow direction and the outflow direction of the oil by moving according to the difference in pressure between the first and second oil passages 32 and 33 is provided in the housing 91 as the path switching device 131 for controlling the operation of the oil pump, and the spool 97 is supported so as to be movable to the first movement position for setting the first oil passage 32 to the oil outflow direction and switching the second oil passage 33 to the oil inflow direction and to the second movement position for setting the first oil passage 32 to the oil inflow direction and switching the second oil passage 33 to the oil outflow direction, and is biasingly supported at the first movement position by the gravity as the biasing means.

Therefore, by biasingly supporting the spool 97 at the first movement position, backflow of the oil can be prevented when starting the oil pump, and it is possible to discharge the oil at an early stage to supply to the oil supplying unit 84, and by vertically arranging the housing 91 of the spool 97, it is possible to allow the gravity to act on the spool 97, to easily biasingly support the same at the first movement position, so that the simple structure can be obtained.

Also, in the third embodiment, the input shaft 14 is coupled to the first rotating member 25 of the oil pump 22, the output shaft 45 is coupled to the second rotating member 36, and when the rotational speed of the first rotating member 25 is higher than that of the second rotating member 36, the high-pressure oil passage is set as the first oil passage 32, and the low-pressure oil passage is set as the second oil passage 33.

Therefore, when starting the engine 11, the backflow of the oil in the oil pump can be prevented, and the oil can be supplied to the oil supplying unit 84 at the early stage by the oil pump.

Fourth Embodiment

Figure 10:
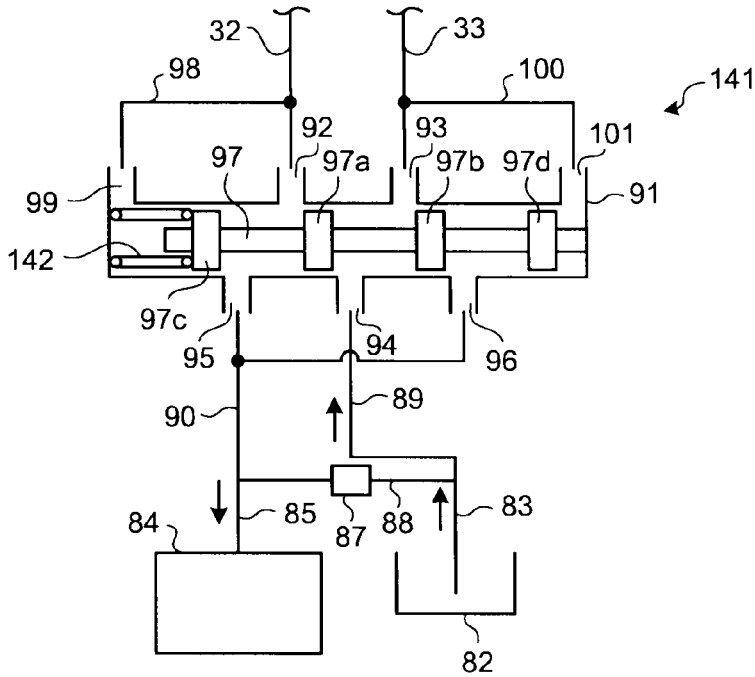
FIG. 10 is a schematic configuration diagram of the path switching device applied to the oil pump showing the hydraulic apparatus according to a fourth embodiment of the present invention.

FIG. 10 is a schematic configuration diagram of the path switching device applied to the oil pump showing the hydraulic apparatus according to a fourth embodiment of the present invention. Meanwhile, an entire structure of the hydraulic apparatus of this embodiment is substantially similar to that of the above-described first embodiment, so that this is described with reference to FIGS. 1 and 2, and the same reference numeral is given to the member having the function similar to that described in the first embodiment and the description thereof is not repeated.

The oil pump as the hydraulic apparatus of the fourth embodiment is provided with a path switching device 141 for controlling the operation thereof, as shown in FIG. 10. In the path switching device 141, the housing 91 has the hollow shape, and the first port 92 communicating with the first oil passage 32 and the second port 93 communicating with the second oil passage 33 are formed, and the suction port 94 communicating with the second oil suction path 89 and the two exhaust ports 95 and 96 communicating with the second oil exhaust path 90 are formed therein. Also, the first pressure port 99 communicating with the first branched path 98 branched from the first oil passage 32 and the second pressure port 101 communicating with the second branched path 100 branched from the second oil passage 33 are formed in the housing 91. In the housing 91, the spool 97 is movably supported and the four valve units 97*a*, 97*b*, 97*c* and 97*d* are formed.

In this embodiment, the spool 97 is movable to the first movement position for setting the first oil passage 32 to the outflow direction of the oil and switching the second oil passage 33 to the inflow direction of the oil and to the second movement position for setting the first oil passage 32 to the inflow direction of the oil and switching the second oil passage 33 to the outflow direction of the oil according to the difference in pressure between the first and second oil passages 32 and 33, and is biasingly supported at the first movement position by the compression coil spring 142 as the biasing means. In this case, the compression coil spring 142 is interposed between the end face on the first pressure port 99 side of the housing 91 and the valve unit 97*c* of the spool 97.

Therefore, in the path switching device 141, the spool 97 moves to the first movement position by the biasing force of the compression coil spring 142 to stop, and at that time, the first port 92 communicates with the exhaust port 95 by the valve unit 97*a* and the second port 93 communicates with the suction port 94 by the valve unit 97*b*. In this state, when the oil pressure in the first oil passage 32 is higher than that in the second oil passage 33 as the second fluid path, the oil pressure in the first oil passage 32 acts from the first pressure port 99 through the first branched path 98 on the valve unit 97*c*, so that the spool 97 is held at the first movement position. Therefore, the oil pressure in the second oil suction path 89 flows through the suction port 94 and the second port 93 to the second oil passage 33, and the oil pressure in the first oil passage 32 flows through the first port 92 and the exhaust port 95 to the second oil exhaust path 90.

On the other hand, when the oil pressure in the second oil passage 33 becomes higher than that in the first oil passage 32, the oil pressure in the second oil passage 33 acts from the second pressure port 101 through the second branched path 100 on the valve unit 97*d*, so that the spool 97 moves against the biasing force of the compression coil spring 142 and stops at the second movement position. Therefore, the first port 92 communicates with the exhaust port 94 by the valve unit 97*a* and the second port 93 communicates with the exhaust port 96 by the valve unit 97*b*, and the oil pressure in the second oil suction path 89 flows through the suction port 94 and the first port 92 to the first oil passage 32, and the oil pressure in the second oil passage 33 flows through the second port 93 and the exhaust port 96 to the second oil exhaust path 90.

In this manner, in the hydraulic apparatus of the fourth embodiment, the spool 97 for switching the inflow direction and the outflow direction of the oil by moving according to the difference in pressure between the first and second oil passages 32 and 33 is provided in the housing 91 as the path switching device 141 for controlling the operation of the oil pump, and the spool 97 is supported so as to be movable to the first movement position for setting the first oil passage 32 to the oil outflow direction and switching the second oil passage 33 to the oil inflow direction and to the second movement position for setting the first oil passage 32 to the oil inflow direction and switching the second oil passage 33 to the oil outflow direction, and is biasingly supported at the first movement position by the biasing force of the compression coil spring 142.

Therefore, by biasingly supporting the spool 97 at the first movement position by the biasing force of the compression coil spring 142, the backflow of the oil can be prevented when starting the oil pump, and it is possible to discharge the oil at the early stage to supply to the oil supplying unit 84, and by interposing the compression coil spring 142 between the housing 91 and the spool 97, spring force is allowed to always act on the spool 97 to biasingly support the same at the first movement position, and operability of the spool 97 can be improved.

Fifth Embodiment

Figure 11:
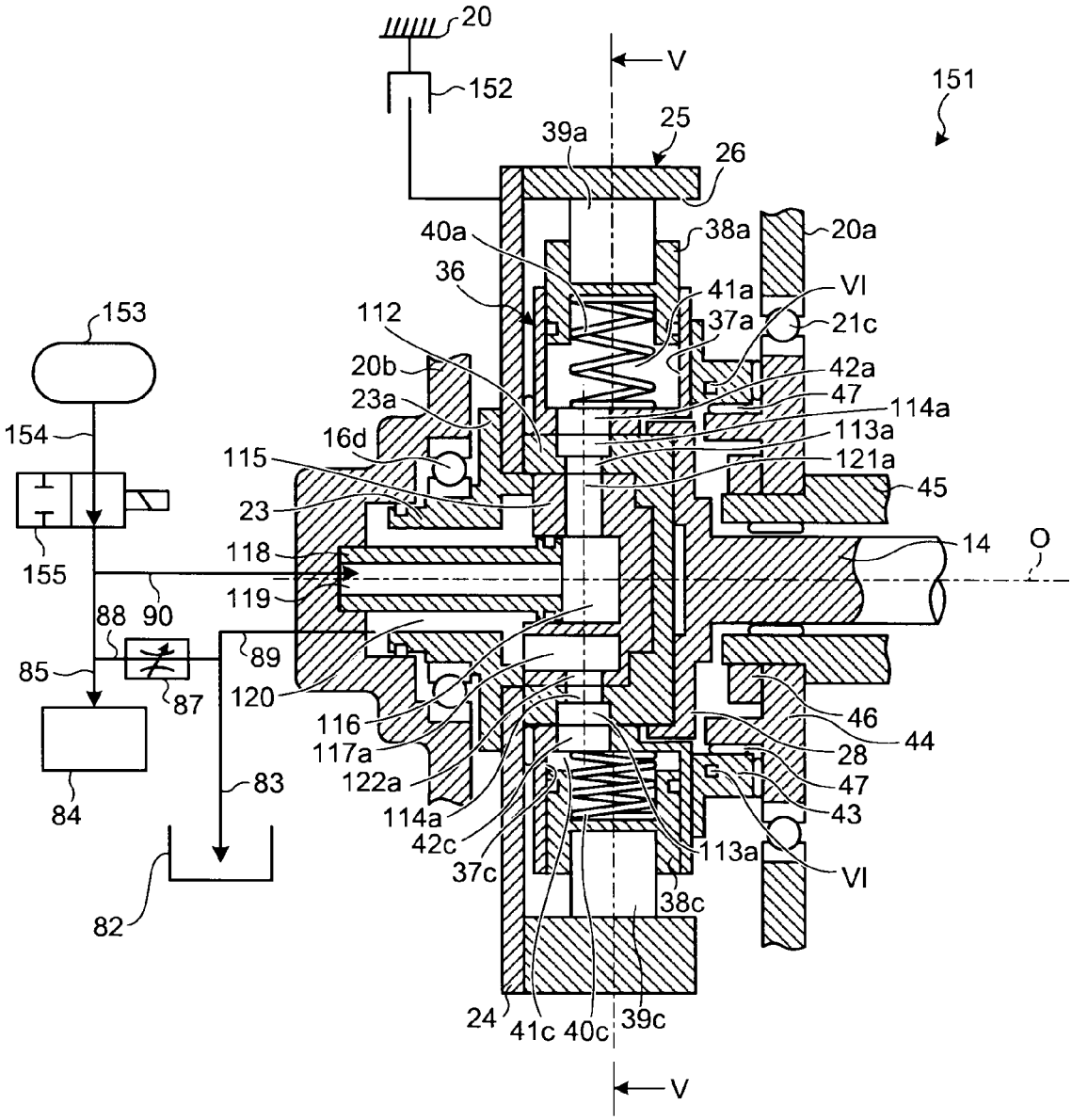
FIG. 11 is a schematic configuration diagram of the oil pump showing the hydraulic apparatus according to a fifth embodiment of the present invention.

FIG. 11 is a schematic configuration diagram of the oil pump showing the hydraulic apparatus according to a fifth embodiment of the present invention. Meanwhile, an entire structure of the hydraulic apparatus of this embodiment is substantially similar to that of the above-described second embodiment, so that this is described with reference to FIGS. 5 and 6 in addition to FIG. 11 and the same reference numeral is given to the member having the function similar to that described in the second embodiment and the description thereof is not repeated.

In the fifth embodiment, as shown in FIGS. 5, 6 and 11, an oil pump 151 as the hydraulic apparatus is composed such that the first and second rotating members 25 and 36 are supported so as to be relatively rotatable, the input shaft 14 is coupled to the first rotating member 25 through the rotary valve 27 and the cam 26 is provided on the first rotating member 25, the pistons 38*a* to 38*h* are movably supported on the second rotating member 36 and are pressed against the cam 26 by the compression coil springs 40*a* to 40*h*, respectively, and the output shaft 45 is coupled. The oil chambers 41*a* to 41*h* of which volumes are expanded and contracted according to the movements of the pistons 38*a* to 38*h* are provided on the second rotating member 36, and the first fluid path (first oil passage 32) and the second fluid path (second oil passage 33) through which the oil flows into or out from the oil chambers 41*a* to 41*h* are provided.

Also, the rotating body 115 is rotatably supported inside the second rotating member 36, and on the rotating body 115, the exhaust chamber 116 with which the second oil suction path 89 communicates and the first or second fluid path can communicate and the suction chambers 117*a* and 117*b* with which the second oil exhaust path 90 communicates and the first or second fluid path can communicate are provided, and the first pressure chambers 123*a* and 123*b* capable of rotating by the pressure in the first fluid path acting on the rotating body 115 and the second pressure chambers 124*a* and 124*b* capable of rotating by the pressure in the second fluid path acting on the rotating body 115 are provided, and the communication relationship between the first and second fluid paths and the suction chamber 116 and the exhaust chambers 117*a* and 117*b* can be switched according to the rotational position of the rotating body 115.

In this case, the rotating body 115 is capable of switching to the inflow direction of the oil and the outflow direction of the oil by moving to the first movement position (position indicated in FIG. 6) and the second movement position (position indicated in FIG. 8) according to the difference in pressure between the first and second fluid paths, and a compression coil spring (not shown) for biasing the rotating body 115 to the first movement position is provided between the rotary valve 112 and the rotating body 115.

In this embodiment, a brake 152 as restraining means is provided between the rear case 20 composing the casing 17 and the rotating plate 24 integral with the first rotating member 25. As the brake 152, the friction brake, the mesh brake and the electromagnetic brake can be applied, and when applying the friction brake and the mesh brake, the hydraulic control actuator is used, and when applying the electromagnetic brake, the electromagnetic control actuator is used, and the actuators can be controlled by the electronic control unit according to an operating state of the vehicle. Also, an oil pressure source 153 as fluid supplying means is coupled to the oil exhaust path 85 through an oil supplying path 154, and an electromagnetic on-off valve 155 is provided on the oil supplying path 154.

Also, the second oil exhaust path 90 branches into the first oil exhaust path 85 and the oil circulation path 88, and a part of the oil exhausted from the oil pump 22 flows through the first oil exhaust path 85 to the oil supplying unit 84, and the rest flows to the oil circulation path 88. The oil flowing to the oil circulation path 88 joins the oil flowing from the first oil suction path 83 and is returned to the second oil suction path 89. The control valve 87 is provided on the oil circulation path 88. The control valve 87 is the flow amount adjusting valve and the discharge amount from the oil pump 22 can be adjusted by adjusting the opening thereof.

Therefore, the engine is driven and the first and second rotating members 25 and 36 rotate in the same direction (in the counterclockwise direction in FIG. 5), and when the rotational speed of the first rotating member 25 is higher than that of the second rotating member 36, the second rotating member 36 rotates in the direction relatively opposite to that of the first rotating member 25 (in the clockwise direction in FIG. 5). Therefore, the pistons 38*b*, 38*c*, 38*f* and 38*g* move outward from the cylinders 37*b*, 37*c*, 37*f* and 37*g* to expand the oil chambers 41*b*, 41*c*, 41*f* and 41*g*, and the oil chambers 41*b*, 41*c*, 41*f* and 41*g* communicate with the coupling holes 42*b*, 42*c*, 42*f* and 42*g*, the coupling grooves 113*b*, 113*d*, and the coupling holes 113*b* and 114*d*. On the other hand, the pistons 38*h*, 38*a*, 38*d* and 38*e* move inward of the cylinders 37*h*, 37*a*, 37*d* and 37*e* to contract the oil chambers 41*h*, 41*a*, 41*d* and 41*e*, and the oil chambers 41*h*, 41*a*, 41*d* and 41*e* communicate with the coupling holes 42*h*, 42*a*, 42*d* and 42*e*, the coupling grooves 113*a* and 113*c*, and the coupling holes 114*a* and 114*c*.

In this case, the oil chambers 41*b*, 41*c*, 41*f* and 41*g* are expanded and the oil chambers 41*h*, 41*a*, 41*d* and 41*e* are contracted, so that the oil pressures in the coupling holes 114*a* and 114*c* become higher than the oil pressures in the coupling holes 114*b* and 114*d*, and the oil pressures in the coupling holes 114*a* and 114*c* act on the first pressure chambers 123*a* and 123*b* to move the rotating body 115 to the first position. Then, the oil from the oil circulation path 88 flows to the second oil suction path 89 and the oil in the oil retaining unit 82 also flows through the first oil suction path 83 to the second oil suction path 89, flows through the suction oil passage 120 to be sucked into the oil chambers 41*b*, 41*c*, 41*f* and 41*g*. On the other hand, the oil in the oil chambers 41*h*, 41*a*, 41*d* and 41*e* flows through the exhaust oil passage 119 to the second oil exhaust path 90, and a part thereof is discharged through the first oil exhaust path 85 to the fluid supplying unit 84 and the rest flows to the oil circulation path 88.

On the other hand, the first and second rotating members 25 and 36 rotate in the same direction (in the counterclockwise direction in FIG. 5), and when the rotational speed of the first rotating member 25 is lower than that of the second rotating member 36, the first rotating member 25 rotates in the direction relatively opposite to that of the second rotating member 36 (in the counterclockwise direction in FIG. 5). Therefore, the pistons 38*a*, 38*b*, 38*e* and 38*f* move outward from the cylinders 37*a*, 37*b*, 37*e* and 37*f* to expand the oil chambers 41*a*, 41*b*, 41*e* and 41*f*, and the oil chambers 41*a*, 41*b*, 41*e* and 41*f* communicate with the coupling holes 42*a*, 42*b*, 42*e* and 42*f*, the coupling grooves 113*a* and 113*c*, and the coupling holes 114*a* and 114*c*. On the other hand, the pistons 38*c*, 38*d*, 38*g* and 38*h* move inward of the cylinders 37*c*, 37*d*, 37*g* and 37*h* to contract the oil chambers 41*c*, 41*d*, 41*g* and 41*h*, and the oil chambers 41*c*, 41*d*, 41*g* and 41*h* communicate with the coupling holes 42*c*, 42*d*, 42*g* and 42*h*, the coupling grooves 113*b* and 113*d*, and the coupling holes 114*b* and 114*d*.

In this case, the oil chambers 41*a*, 41*b*, 41*e* and 41*f* are expanded and the oil chambers 41*c*, 41*d*, 41*g* and 41*h* are contracted, so that the oil pressures in the coupling holes 114*b* and 114*d* become higher than the oil pressures in the coupling holes 114*a* and 114*c*, and the oil pressures in the coupling holes 114*b* and 114*c* act on the second pressure chambers 124*a* and 124*b* to move the rotating body 115 to the second position. Then, the oil from the oil circulation path 88 flows to the second oil suction path 89 and also the oil in the oil retaining unit 82 flows through the first oil suction path 83 to the second oil suction path 89, and is sucked into the oil chambers 41*a*, 41*b*, 41*e* and 41*h* through the suction oil passage 120. On the other hand, the oil in the oil chambers 41*c*, 41*d*, 41*g* and 41*h* flows through the exhaust oil passage 119 to the second oil exhaust path 90, and a part thereof is discharged through the first oil exhaust path 85 to the fluid supplying unit 84 and the rest flows to the oil circulation path 88.

Also, when the engine stops, the oil pump 151 of this embodiment can be used as the motor. That is to say, by activating the brake 152, in a state in which the first rotating member 25 is restrained, the electromagnetic on-off valve 154 is opened and the control valve 87 is fully closed, and the oil pressure is discharged from the oil pressure source 153. Then, the oil pressure of the oil pressure source 153 is supplied from the oil supplying path 154 through the second oil exhaust path 90 to the oil supplying unit 84 and is supplied to the oil pump 151. At that time, since the rotating body 115 is biasingly supported at the first movement position by the biasing force of the compression coil spring, the oil chambers 41*b*, 41*c*, 41*f* and 41*g* communicate with the coupling holes 114*b* and 114*d* through the coupling holes 42*b*, 42*c*, 42*f* and 42*g* and the coupling grooves 113*b* and 113*d*, and the oil chambers 41*h*, 41*a*, 41*d* and 41*e* communicate with the coupling holes 114*a* and 114*c* through the coupling holes 42*h*, 42*a*, 42*d* and 42*e* and the coupling grooves 113*a* and 113*c*.

Therefore, the oil pressure of the oil pressure source 153 flows from the oil supplying path 154 and the second oil exhaust path 89 through the exhaust oil passage 119 and the exhaust chamber 116, and is supplied to the oil chambers 41*a* and 41*e* through the coupling holes 121*a* and 121*b*, the coupling holes 114*a* and 114*c*, the coupling grooves 113*a* and 113*c* and the coupling holes 42 and 42*e*. Then, the oil chambers 41*a* and 41*e* are expanded by the supply of the oil pressure, and the pistons 38*a* and 38*e* move outward, so that the second rotating member 25 rotates in the counterclockwise direction in FIG. 5 through the cam 26. At that time, the oil in the oil chambers 41*c* and 41*g* is returned to the oil retaining unit 82 through the second oil suction path 89. That is to say, the second rotating member 36 rotates relative to the first rotating member 25, which is stopping, so that the torque of the second rotating member 36 is transmitted to the output shaft 45. Therefore, even when the engine is stopping, by driving the oil pump 151, it is possible to rotate the output shaft 45 to ensure the torque, and the vehicle can travel by the torque. Also, it is possible to take out the torque of the output shaft 45 to drive an auxiliary machine or the like.

In this manner, in the hydraulic apparatus of the fifth embodiment, the first and second rotating members 25 and 36 are supported so as to be relatively rotatable, the cum 26 is provided on the first rotating member 25, the pistons 38*a* to 38*h* movable while contacting the cam 25 are supported on the second rotating member 36, the first and second fluid paths through which the oil flows into and out from the oil chambers 41*a* to 41*h* of which volumes are expanded and contracted according to the movements of the pistons 38*a* to 38*h* are provided, the rotating body 151 for switching the flow direction of the oil by rotating according to the difference in pressure between the first and second fluid paths is provided, the brake 152 for restraining the first rotating member 25 is provided, and the oil pressure source 153 for supplying the oil pressure to the first fluid path is provided.

Therefore, when the engine is stopping, by supplying from the oil pressure source 153 through the second oil exhaust path 90 to the oil chambers 41*a* to 41*h* to rotate the second rotating member 25 by moving the pistons 38*a* to 38*h*, the torque of the second rotating member 36 can be output to the output shaft 45, and the oil pump 151 is allowed to serve as the motor.

Also, by interposing the compression coil spring between the rotary valve 112 and the rotating body 115, the rotating body 115 is biased at the first movement position. Therefore, by biasingly supporting the rotating body 115 at the first movement position, when starting the oil pump 151 in a state in which the engine is stopping, the second rotating member 36 can be rotated in the positive rotation direction and the appropriate torque can be ensured.

Meanwhile, although the first and second rotating members 25 and 36 are supported so as to be relatively rotatable, the input shaft 14 is coupled to the first rotating member 25 through the rotary valves 27 and 112, and the output shaft 45 is coupled to the second rotating member 36 in the above-described embodiments, the output shaft 45 may be coupled to the first rotating member 25 through the rotary valves 27 and 112, and the input shaft 14 may be coupled to the second rotating member 36.

Also, although the gravity by the vertical arrangement of the spool 97 or the biasing force of the compression coil spring 152 are used as the biasing means in the above-described embodiments, another spring such as tensile spring or plate spring and rubber or resin may be used as the biasing means. In addition, the biasing means may be provided on the rotating body of the second embodiment.

Further, although the input shaft 14 is coupled to the first rotating member 25, the output shaft 45 is coupled to the second rotating member 36, and the first rotating member 25 can be restrained by the brake 152 in the above-described fifth embodiment, when the input shaft 14 is coupled to the second rotating member 36 and the output shaft 45 is coupled to the first rotating member 25, the second rotating member 36 may be restrained by the brake 152.

INDUSTRIAL APPLICABILITY

As described above, the hydraulic apparatus according to the present invention is for supplying the fluid to the predetermined oil passage regardless of the rotational direction of the rotating member, and further, for improving the mechanical efficiency and improving the versatility, and is preferably used in all kinds of hydraulic apparatuses.

The invention claimed is:

1. A hydraulic apparatus comprising:
- a first rotating member and a second rotating member provided so as to be relatively rotatable with a central axis;
- a cam provided on the first rotating member;
- a piston provided on the second rotating member so as to be opposed to the cam and movable along a radial direction;
- a pressing unit that presses the piston against the cam so that the piston and the cam contact;
- a fluid chamber provided on the second rotating member, the chamber having a volume expanded and contracted according to a movement of the piston;
- a first fluid path and a second fluid path through which fluid flows into or out from the fluid chamber; and
- a path switching device that switches an inflow direction and an outflow direction of the fluid in the first fluid path and the second fluid path according to difference in pressure between the first fluid path and the second fluid path.

2. The hydraulic apparatus according to claim 1, wherein the path switching device has a moving body that switches the inflow direction and the outflow direction of the fluid in the first fluid path and the second fluid path by moving according to the difference in pressure between the first fluid path and the second fluid path.

3. The hydraulic apparatus according to claim 2, wherein the moving body is movable to a first movement position for setting the first fluid path to the outflow direction of the fluid and switching the second fluid path to the inflow direction of the fluid, and to a second movement position for setting the first fluid path to the inflow direction of the fluid and switching the second fluid path to the outflow direction of the fluid, and the moving body is biasingly supported at the first movement position by a biasing unit.

4. The hydraulic apparatus according to claim 3, wherein an input shaft is coupled to the first rotating member and the output shaft is coupled to the second rotating member, and the biasing unit biasingly supports the moving body such that a pressure in the first fluid path or the second fluid path communicating with a fluid supplying unit becomes higher when a rotational speed of the first rotating member is higher than the rotational speed of the second rotating member.

5. The hydraulic apparatus according to claim 1, wherein the path switching device includes:

a housing;

a first port and a second port provided in the housing with which the first fluid path and the second fluid path communicate, respectively;

a suction port and an exhaust port provided in the housing with which a fluid suction path and a fluid exhaust path communicate;

a spool movably supported in the housing that switches a communication relationship between the first port and the second port and the suction port and the exhaust port;

a first pressure port provided in the housing with which a pressure in the first fluid path acts on the spool; and a second pressure port provided in the housing with which the pressure in the second fluid path acts on the spool.

6. The hydraulic apparatus according to claim 1, wherein the path switching device includes:

a rotating body concentrically and rotatably supported inside the second rotating member;

a suction chamber provided on the rotating body with which a fluid suction path communicates and the first fluid path or the second fluid path can communicate;

an exhaust chamber provided on the rotating body with which a fluid exhaust path communicates and the first fluid path or the second fluid path can communicate;

a first pressure chamber rotatable by the pressure in the first fluid path acting on the rotating body; and a second pressure chamber rotatable by the pressure in the second fluid path acting on the rotating body, and wherein the path switching device is capable of switching a communication relationship between the first fluid path and the second fluid path and the suction chamber and the exhaust chamber according to a rotational position of the rotating body.

7. The hydraulic apparatus according to claim 1, wherein the path switching device is coupled to a fluid retaining unit through the fluid suction path and is coupled to the fluid supplying unit through the fluid exhaust path, and a control valve that controls a flow of the fluid is provided in at least one of the fluid suction path and the fluid exhaust path.

8. The hydraulic apparatus according to claim 1, wherein an input shaft is coupled to one of the first rotating member and the second rotating member and an output shaft is coupled to the other of the first rotating member and the second rotating member, the piston reciprocates according to a difference in rotational speed between the first rotating member and the second rotating member, and the fluid is sucked and discharged through the first fluid path and the second fluid path by varying pressure in the fluid chamber.

9. The hydraulic apparatus according to claim 1, further comprising a restraining unit capable of restraining the first rotating member or the second rotating member, and a fluid supplying unit capable of supplying the fluid in the first fluid path or the second fluid path.

* * * * *